US006668491B1

(12) United States Patent
Bonerb

(10) Patent No.: US 6,668,491 B1
(45) Date of Patent: Dec. 30, 2003

(54) DEVICE FOR REMOVING ICE FROM ROOFS

(76) Inventor: Timothy C. Bonerb, P.O. Box 164, Jackson, NH (US) 03846

( * ) Notice: Subject to any disclaimer, the term of this patent is extended or adjusted under 35 U.S.C. 154(b) by 0 days.

(21) Appl. No.: 09/744,903

(22) PCT Filed: Mar. 3, 1998

(86) PCT No.: PCT/US98/04193

§ 371 (c)(1),
(2), (4) Date: Jan. 30, 2001

(87) PCT Pub. No.: WO98/39534

PCT Pub. Date: Sep. 11, 1998

Related U.S. Application Data

(60) Provisional application No. 60/040,005, filed on Mar. 3, 1997.

(51) Int. Cl.[7] ..... E04B 1/62

(52) U.S. Cl. ..... 52/1; 52/2.13; 52/11; 52/24; 52/96; 52/97; 52/741.3

(58) Field of Search ..... 52/1, 2.13, 11, 52/13, 24, 96, 97, 741.3

(56) References Cited

U.S. PATENT DOCUMENTS 2,069,600 A * 2/1937 Coleman
2,618,987 A * 11/1952 Goldstine
3,157,002 A 11/1964 Herman
4,089,127 A 5/1978 Maijala
4,729,416 A * 3/1988 Miller
4,745,709 A 5/1988 Johnson
5,337,978 A 8/1994 Fahrner et al.
5,722,672 A * 3/1998 Frederick
5,746,027 A 5/1998 Bonerb
5,752,347 A 5/1998 Osborn

* cited by examiner

*Primary Examiner*—Robert Canfield
(74) *Attorney, Agent, or Firm*—Phillip E. Decker

(57) ABSTRACT

A device for removing ice and snow from roofs (10) comprising an inflatable sleeve (19) secured to a mounting frame secured on a roof under shingles or panels (56). Inflating the sleeve (19) fractures ice and snow adhering to the top of the apparatus, causing ice and snow to fall to the ground in a controlled manner. An inflation mechanism can be provided suitably adapted to prevent moisture damage to the system, and to provide warm air to the inflatable sleeve (19) to facilitate the release of ice and snow. Alternatively, a non-inflatable flexible cover (121) can be provided and secured to an eave or side of a building, and then agitated to remove ice and snow. A flexible gutter apparatus (223) can also be provided, having a flexible gutter disposed onto rigid support frame segments and secured to its edges so that the contents of the gutter can be expelled by lifting the flexible gutter over the frame.

40 Claims, 15 Drawing Sheets

DEVICE FOR REMOVING ICE FROM ROOFS

This application claims the benefit of U.S. Provisional Application No. 60/040,005, filed Mar. 3, 1997.

BACKGROUND

1. Field of the Invention

The invention relates to a device and method for removing ice and snow from roofs and overhangs.

2. Description of the Related Art

A common problem found throughout the world is the buildup of ice and snow on the roofs of buildings during the winter months of the year. The problem can be seen on all types of buildings, from small cottages to the largest of industrial and commercial complexes. Typically, as the snow sits on a sloped roof, the bottom portion of the roof area will begin to show ice buildup in the form of ice dams after only a few days. As ice begins to form on the roof, the problem is further compounded by the formation of icicles and other ice formations in the gutter and eave section of many roofs. While the formation of ice may cause damage to a building's gutters, roof, eave and walls, the formation of icicles can lead to a much greater problem—falling ice. The resulting problems of ice and snow buildup on outdoor structures are well known and include damage to structures, interior and exterior water damage, excessive roof loading, which may eventually lead to roof failure, falling ice, which may injure people located below the ice formation, window damage, gutter damage, etc.

One of the main problems caused by ice dams is water damage to exterior and interior structures of a building. Even when underlayment materials are laid down between the wood decking and shingles, leaking remains a problem—especially on roofs that have a shallow slope. The shallower the slope of the roof, whether it comprises metal, fiberglass and plastic panels, tiles or shingles, the greater the potential for leaking to occur.

Particular problems exist with shallow sloped panel roofs. The snow and ice compresses and the bottom layer next to the roof turns into a solid sheet of ice. Under its own weight and in response to the roofs slope angle, the entire ice and snow pack will slide down the roof and extend over the edge. In many cases the bottom layer will turn into a solid sheet of ice, in some cases several inches thick, and will actually slide outward from the edge of the roof by several feet. Most pedestrian walk ways and parking lots near these roofs are barricaded in the winter because of the hazard created. Eventually the ice pack will either slide off all at once or break off. In either case, up to one hundred pounds or more of ice and snow pack per foot of roof line may suddenly come crashing down. Even though the ice pack can slide down the roof up to a few inches per day, it still acts as a dam and may cause runoff to back up on the roof and cause leaking. Another problem created by the ice and snow pack remaining on the edge of a building, especially around parking lots, truck docks, freight terminals, restaurants, shopping malls, post offices and other high traffic areas is the melting of the ice that drips down and may refreeze on the ground surfaces.

Ice dams become very serious problems when interior leaking occurs. When it happens, it is not a problem that can be solved quickly, safely, or easily. Typically, someone must be hired to begin shoveling snow off of the roof. Next, the person may use an ax and ice melting chemicals to remove the ice dam. The person must stand on a slippery roof near the edge, which is very hazardous. Ice strongly bonds to shingles, making it hard to remove. During chopping with an ax, damage to the shingles often results. The work is very labor intensive, expensive, and dangerous.

Several devices and techniques have been employed in the prior art to attempt to overcome these problems. One method is to use an electric heating tape strung over vast sections of roofs to melt ice and snow. Not only are heating tapes unsightly, but also draw expensive electric power.

Another method is to climb onto a roof and shatter the ice with a hard, blunt object, like a shovel, hammer, pipe, or ax. This has the disadvantage of being extremely dangerous, since a person must climb onto a slippery roof. Also, the action of shattering ice with a hard object may also damage the roof.

Another method is to climb onto a roof and chip away at the ice using a sharp object, like an ice chopper or hatchet. This method is even more likely to cause damage to the roof and associated structures.

Similarly, the prior art method for removing icicles is to knock them down from below with a long object like a stick. This method is extremely dangerous.

The methods of shattering with a blunt object, chipping with a sharp object, and knocking down from below, have the additional disadvantage having very high labor costs. Companies that provide these services charge high rates, since the work is hazardous and seasonal. The use of a heating tape to melt large snow and ice on large sections of a roof is also unsatisfactory, since the tape uses wasteful amounts of electric power during a time of year when electricity use is already high. They are also ineffective, since they only heat their immediate area.

Another method involves the use of rigid flashing along the lower roof line of a building. While it does help remove snow from roofs with a fairly moderate to steep slope, they are not very effective in allowing snow to slide off on shallow sloped roofs. Because of the many variable involved, such as the regularity, depth, and frequency of snowfall, temperature, melting and refreezing, sunlight, ice dams, and icicles still form on roofs with metal ice flashing installed. Typically, once the runoff drips down over the eave surface, the ice will freeze to and get a grip on the lower area of a roof. The ice dam problem remains. If the ice stays on the flashing, the ice dam will grow. If the ice dam and icicles fall off the roof, their timing is unpredictable, posing as a hazard. Often times falling ice will cause damage to the eave. The ice flashing is a permanent installation and remains on the roof year round. While it is primarily used on commercial buildings, its use is limited for residential roofs because of its unsightly appearance. Once ice has formed however, the incline of the roof does not easily allow the ice to fall because it may be frozen to the eave of the roof. The other major problem with this design is that there is no way of determining when the ice will fall, creating a dangerous situation.

Another method and device that has been used is the subject of U.S. patent application Ser. No. 08/703,642, by Timothy C. Bonerb. That invention uses an inflatable bladder and mounting flange that breaks off ice and snow when inflated. However, that application does not disclose the substantial improvements that are the subject of the present invention.

For the foregoing reasons, there is a need for an apparatus for removing ice and snow in a controlled manner from the roofs and overhangs of buildings that does not cause damage, can be operated remotely, does not waste energy, and does not require an operator to be on a roof or underneath ice and snow falling from above.

SUMMARY

Accordingly, it is an object of the invention is to allow the user a simple and affordable method for inflating an inflatable sleeve by utilizing an electrical or piston driven leaf blower.

Another object of the invention is to provide a protective exterior cover that will protect the roof from leaking.

Another object of the invention is to provide an extension beyond the buildings sidewall or eave area so that runoff will not freeze and form on the side of the building.

Another object of the invention is to provide the user with a safe and effective method for controlling ice formations as they slide down shallow sloped metal roofs. As the ice formations slide and protrude over the edge of the roof, the ice formations may be broken up and allowed to fall under the user's supervision.

Another object of the invention is to allow the use a high level of safety for controlling and dislodging ice formations as they slide down shallow sloped, panel-type roofs.

Another object of the invention is to provide a smooth and slick surface on the exterior surface of a roof for snow and ice to slide off.

Another object of the invention is to allow the user to manually agitate the flexible shield of the invention to induce the ice and snow to fall off the roof.

Another object of the invention is to provide a protective cover over the existing roof surface (shingles) during ice and snow removal procedures that involve shoveling, scraping, etc. Snow and ice get a good grip on shingles, making it very difficult to get the "ice dam" off the roof even after all the snow above has been removed.

Another object of the invention is to allow moisture that may collect in the inflatable sleeve to drain out without causing damage to the system.

Another object of the invention is to provide a flexible shield with insulation inside to isolate the roofs heat from the snow so that little or no melting takes place.

Another object of the invention is to provide a leak proof, flexible and removable barrier to protect the roof, as well as the interior and exterior surface of the building from water damage.

Another object of the invention is to allow the user to remove the ice from the roof while still frozen, reducing the melting and dripping that may run down the walls of the building and cause damage to the building.

Another object of the invention is to allow the user to remove the ice from the roof of the building before its melts, drips and may refreeze on pedestrian walkways, roadways and parking lots which may cause dangerous and slippery conditions.

Another object of the invention is to allow the gutter systems on the eave to remain functional, preventing ice and snow from refreezing in the gutter and overflowing uncontrolled onto the ground.

Another object of the invention is to use a heat tape mounted on or behind the flexible cover to provide heat to melt snow and ice as well as a smooth surface so the ice and snow can slide off the roof.

Another object of the invention is to use warm or hot air to inflate the flexible inflatable sleeve as well as to recirculate the warm air to melt any snow or ice that may be stuck to the flexible shield.

The foregoing objects are accomplished using a device for removing ice and snow from roofs and overhangs comprising an inflatable sleeve made of a flexible material, an installation mounting frame and method that can be easily interfaced with existing building designs, and a means for inflating the sleeve. This and other features and embodiments of the invention will be made clear in the following drawings and description.

DETAILED DESCRIPTION

Figure 1:
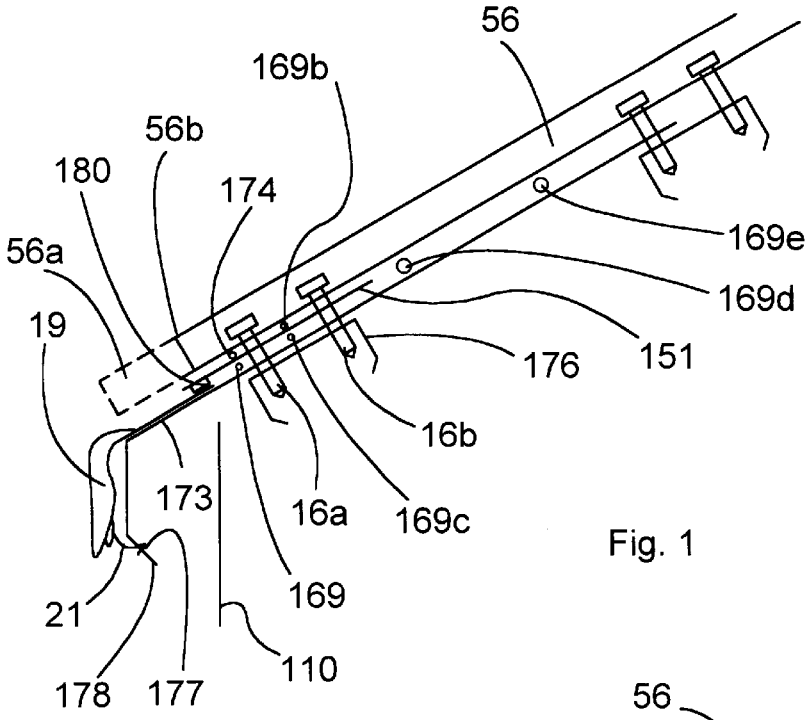
FIG. 1 is a side view of a building with a panel-type roof. The figure shows that the existing bottom panel has been cut and shortened to end at or near the sidewall of the building. Under the panel and above the bottom purlin or roof decking, a rigid insert is installed. The mounting tab, with the inflatable sleeve secured is sandwiched between the bottom of the panel and the rigid insert.

FIG. 1 is a side view of the bottom end of a metal, panel-type roof that is modified for use with this configuration of the invention. A bottom end 56*a* of roof panel 56 is cut back to position 56*b*. Fasteners 16*a* and 16*b* are removed, allowing roof panel 56 to be lifted from its secured position on the roof beam (purlin) 176. A rigid insert panel 173 is installed and caulk or other types of gasketing and sealant materials are applied above and below the insert panel 173 to form a watertight seal. Sandwiched between the bottom 56*b* of the roof panel 56 and the insert panel 173 is a mounting tab 151. Once all components are in place, fasteners 16*a* and 16*b* are reinstalled. The end 178 of the insert panel is positioned away from the sidewall 110 of the building to keep water runoff away from the building. The end 178 acts as a drip edge. Hole(s) 177 are provided approximately every 46 cm along the bottom part of the insert panel 173 to provide a mounting point to hold the shock or bungee cord 21 secured so that the inflatable sleeve 19 is anchored properly. A hook and loop (VELCRO) fastening system 180 is provided to attach an inflatable sleeve 19 to the mounting tab 151 and to allow for easy removal and reinstallation as the seasons dictate. Waterproof sealant 169*a*, 169*b*, 169*c*, 169*d*, 169*e*, such as butyl tape, silicone caulk, and others well known in the art are used in the joint 174 to prevent leaking through the roof panels 56. Special sealants 169 are generally required that have elasticity to move with the roof panels 56 as they constantly expand and contract due to the constant heating and cooling that normally occurs.

FIG. 1 clearly shows the advantages of manufacturing and installing a device for removing ice and snow from roofs. For a panel-type roof, the method comprises the steps of cutting back the panel from the edge of the roof, installing the top part of an inflatable sleeve 19 or cover, and securing the bottom part of the inflatable sleeve or cover to the eave or side of the building.

Figure 2:
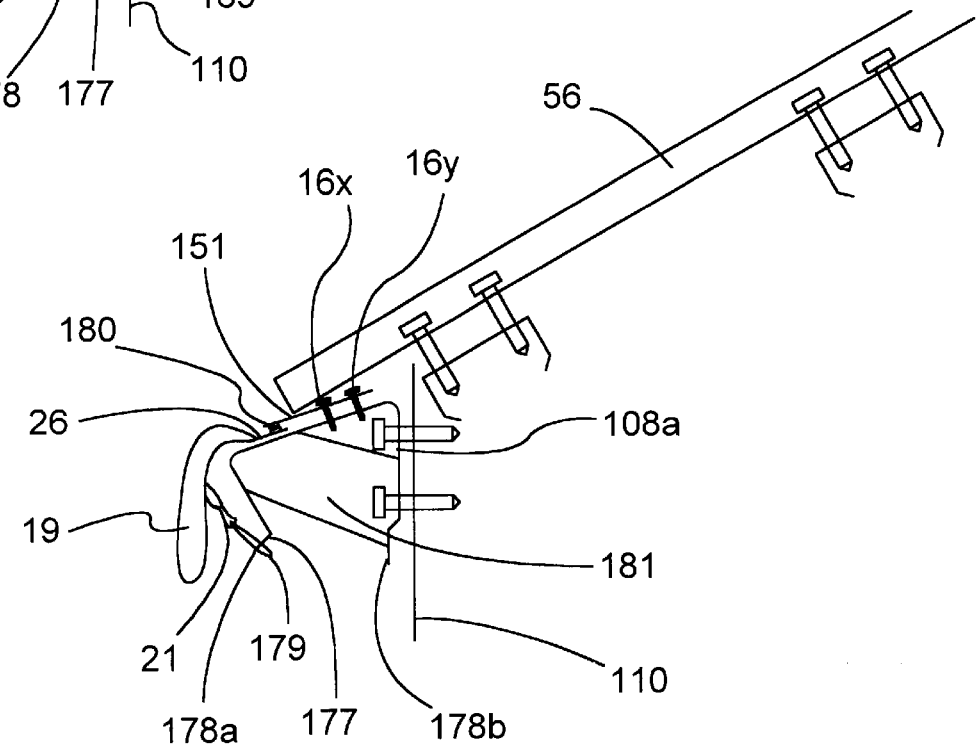
FIG. 2 is a side view of a building with a panel type roof. A rigid u-shaped fixture is secured to the sidewall of the building so that its top side contacts the bottom most panel on the roof. A mounting tab and inflatable sleeve assembly is secured to the rigid U-shaped fixture under the roof panel and extends and is secured to the adjacent side of the U-shaped bracket.

FIG. 2 shows a mounting fixture 108*a* mounted directly to the eave sidewall 110 of a building. It can also be mounted to the eave. In this configuration of the invention, the roof panel 56 is not modified or removed. The mounting tab 151 is fitted to a mounting fixture 108*a* with fasteners 16*x* and 16*y*. Other fastening materials such as adhesives, zippers, hook & loop assemblies and sealants and others may be used. To provide additional support to the mounting fixture 108*a*, a support gusset 181 may be used. The top end of the inflatable sleeve assembly 19 is secured to the mounting tab 151 with a hook and loop assembly 180. A non-inflatable 26 section is provided between the inflatable sleeve 19 and the top of the flexible shield at a fastening assembly 180. The bottom of the inflatable sleeve 19 is secured by an attached cable-tie 179 between a shock cord 21 and a hole 177 in the lower section of the mounting fixture 108*a*. The bottom ends 178*a* and 178*b* are designed to allow any moisture runoff to fall away from the building sidewall 110.

Figure 3:
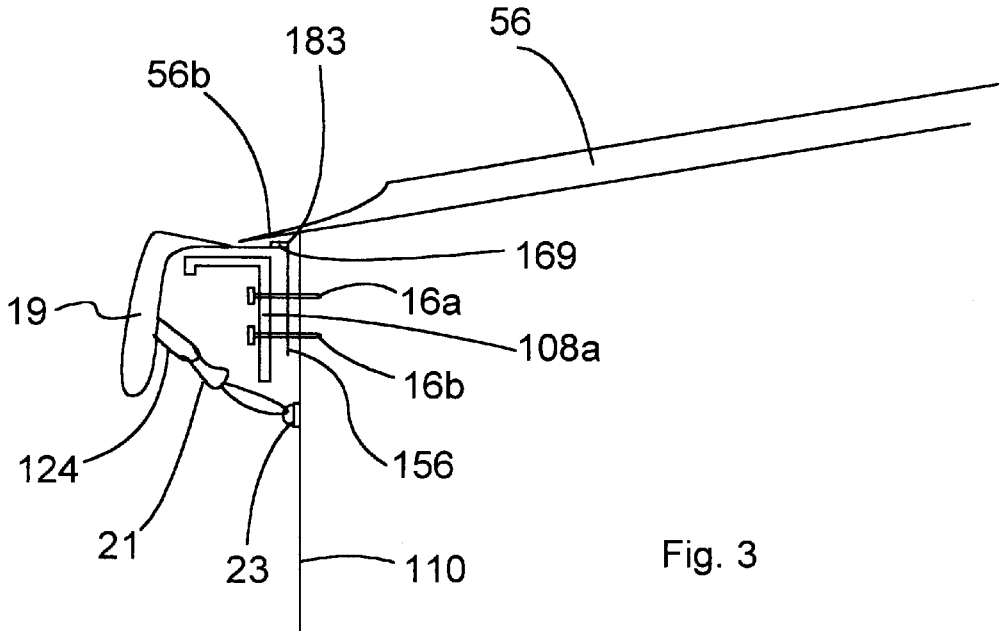
FIG. 3 is a side view of a building with a very shallow sloped panel-type roof system. An inflatable sleeve is sandwiched between a structural fixture that is fastened to the sidewall of the building.

FIG. 3 is a side view of a shallow sloped, panel roof. A mounting fixture 108*a*, which may be a simple plate or standard structural metal or plastic angle, tubing, wood, or other formed component can be affixed to the sidewall 110 or the eave just beneath the bottom edge 56*b* of the panel roof 56. Caulk or sealant 169 may be under the bottom 56*b* of the roof panel 56 at the joint area 183. The top end 156 of the inflatable sleeve 19 is sandwiched between the mounting fixture 108*a* and sidewall 110 with fasteners 16*a* and 16*b*. To provide greater adjust ability, a cable-tie 179 secures a bungee cord 21 contained in a loop 124 with a hook 23. Foam rubber could be used inside the sleeve or against the sidewall as a fixture 108*a*.

Figure 4:
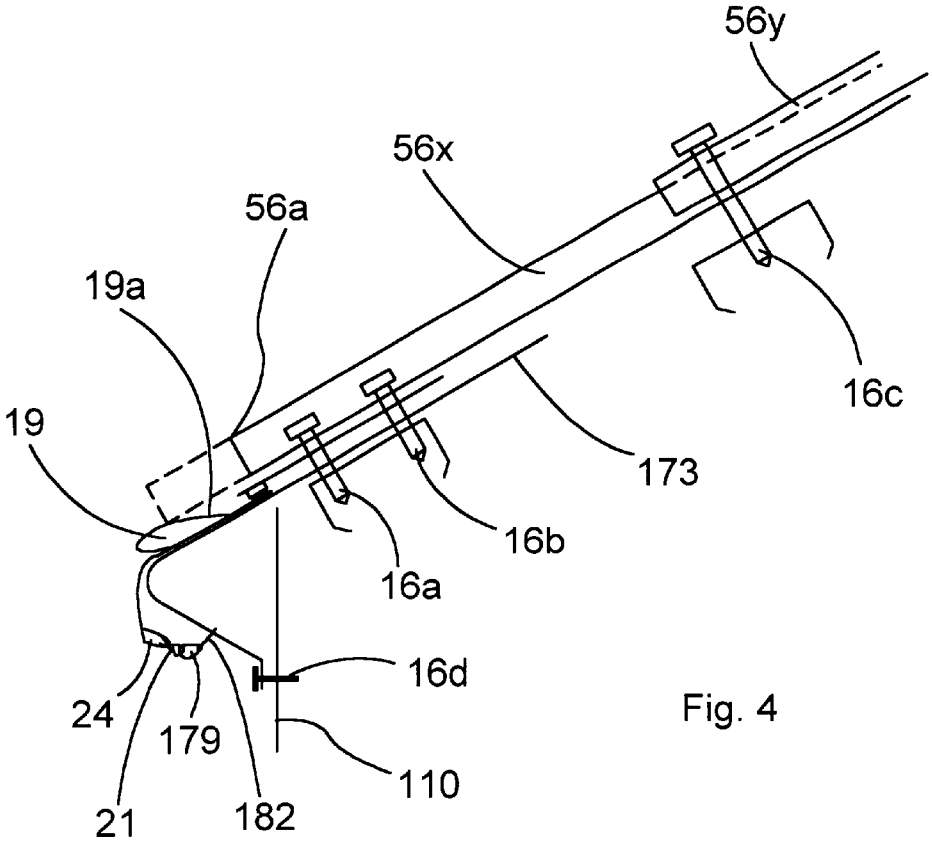
FIG. 4 is the side view of a building with a panel-type roof. The bottom panel is slid up and under the panel above so that its bottom end aligns with the sidewall of the building, allowing space for the rigid insert panel and inflatable sleeve assemblies.

FIG. 4 is a side view of a sectional, panel roof assembly. While most metal roof seams are mechanically crimped together to ensure they are leak proof, some panel type roofs are fastened down in sections using screws and hardware. Rather than cutting the panel 56*x* shorter to reduce the extension length of an insert panel 173 and the top end 19*a* of the inflatable sleeve 19, fasteners 16*a*, 16*b* and 16*c* can be removed, allowing the panel 56*x* to be slid up and under a panel 56*y* so that the end 56*a* of the panel 56*x* is in the desired location. FIG. 4 also illustrates another method of installing the present invention. The method comprises the steps of loosening the fasteners on a roof panel, sliding the panel under another uphill panel, and then installing an inflatable sleeve or cover on the exposed area of the roof below the panel.

Figure 5:
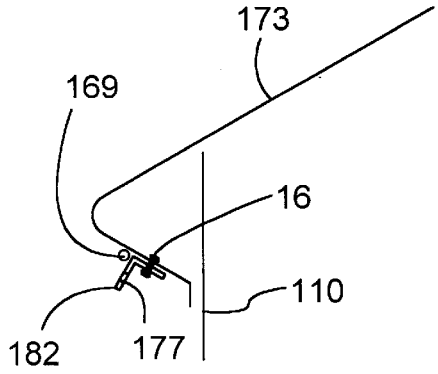
FIG. 5 is a side view of one configuration of the rigid insert panel. The figure shows that a rigid angle has been added to the underside of the rigid insert panel to act as a drip edge and mounting base for the inflatable sleeve.

FIG. 5 is a detailed side view of the drip edge extension 182 that can be a separate component such as metal or plastic angle, strip or other structure. Sealant 169 is placed in the exterior joint where the drip edge 182 angle is fastened to the insert panel 173 with a rivet 16. The insert panel 173 may be made of metal, plastic, fiberglass, or wood. Hole(s) 177 are installed to provide an anchored location to secure the bottom of the inflatable sleeve. The drip edge is useful for directing drips and the flow of water away from the side of a building.

Figure 6:
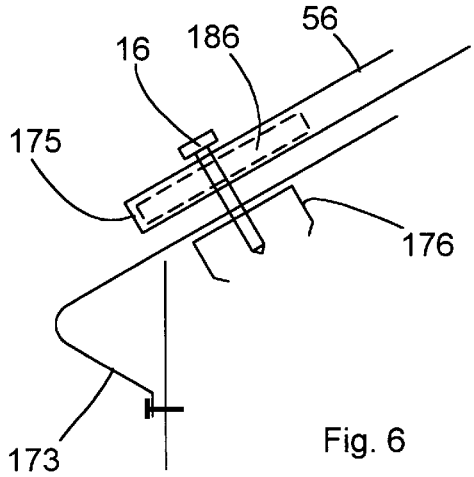
FIG. 6 is a side view of a building showing the detail of an insert secured inside the ridge on a panel roof with the rigid insert panel installed.

FIG. 6 Is a side view of a panel roof system with the insert panel 173 installed. An insert support plug 186 is installed in an opening 175 to prevent foreign materials, insects, birds, water, snow, ice, and such from entering under the panel 56. Additional sealants, polyurethane foams, caulks and other materials may be used to help seal the opening 175. A screw 16 may be installed through the panel 56, insert support plug and purlin 176 to form a tight and secure fit. During the inflation action of the invention, the end of the panel 56 should be bolstered down tightly to the roof and free from any crevices where ice could form. Installing an insert support plug with other sealants, foams, and caulks, or not, is another method of installing the present invention.

Figure 7:
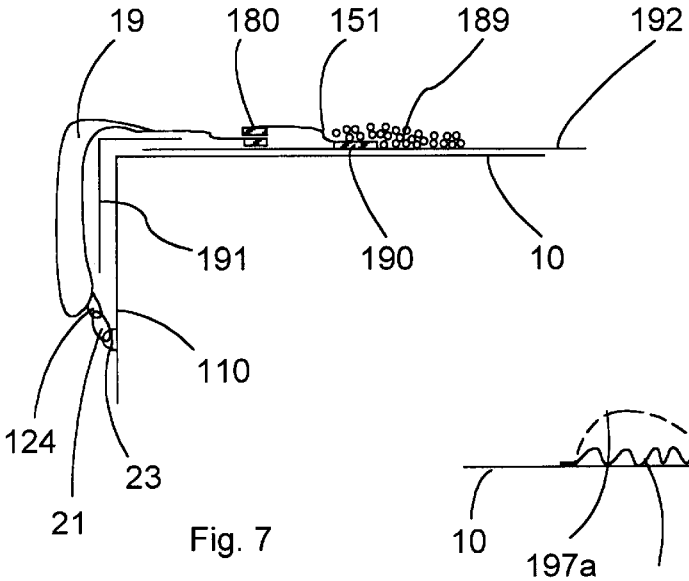
FIG. 7 is a side view of a building with a flat roof. The figure shows the detail of the mounting tab and inflatable sleeve assembly installed.

FIG. 7 is a side view of a building with a flat roof. A waterproof membrane 192, which can be a rubber sheeting or vinyl coated fabric material, rests on the roof decking 10. The waterproof membrane 192 is typically installed on the roof in 91 cm–152 cm wide rolls. The edges of the rolls are seamed together by adhesives or heat sealing. After the waterproof membrane 192 is installed, stones or other types of aggregate material is spread on the roof to hold the membrane 192 in place. A mounting tab 151 is adhered to the waterproof membrane 192 (adhesive or heat sealing depending on the material and recommended sealing technique) so that the inflatable sleeve assembly 19, which can be made of a non-reinforced, elastic rubber sheeting or a coated fabric material, can be attached with a hook and loop connection 180. The inflatable sleeve assembly 19 can be directly adhered to waterproof membrane 192 for a permanent installation. A metal flashing 191 is joined at the top corner joint between the membrane 192 and the sidewall 110. A bungee cord 21 contained in a loop 124 on the inflatable sleeve 19 is attached to a hook 23 mounted on the sidewall 110 of the building. Attaching the flat membrane can be another step in the method of installing the present invention.

Figure 8:
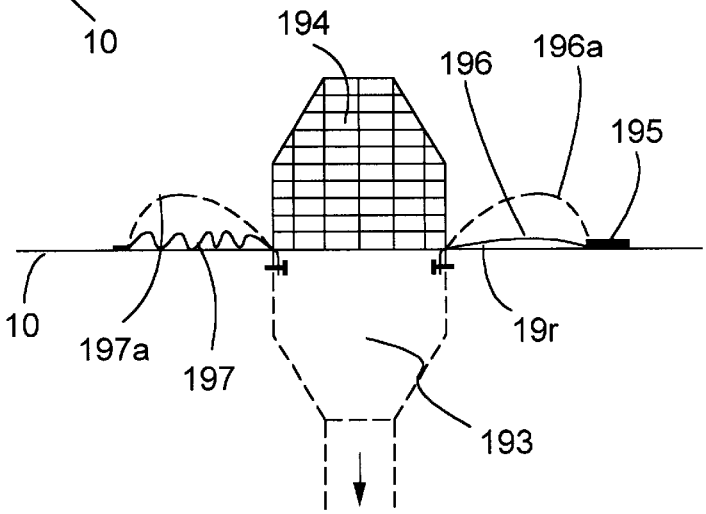
FIG. 8 is a side view of a building with a flat roof. The figure shows the detail of a drainage assembly with an inflatable device around the drain. The inflatable device is shown as being made of an elastic or non-elastic waterproof material.

FIG. 8 is a side view of a building with a flat roof showing the detail of a drainage assembly 193. Surrounding a cage 194 on the surface of the roof 10, is an inflatable ring 19*r* held in place by a clamp ring 195. The material 196 that is used on the right half of the inflatable ring 19*r* is elastic, showing full inflation at position 196*a*. The left half of the inflatable ring 19*r* is made of non-elastic material 197 and is shown at its full inflation position at 197*a*. In actual use, one would use either elastic or non-elastic material for inflatable ring 19*r*.

Figure 9:
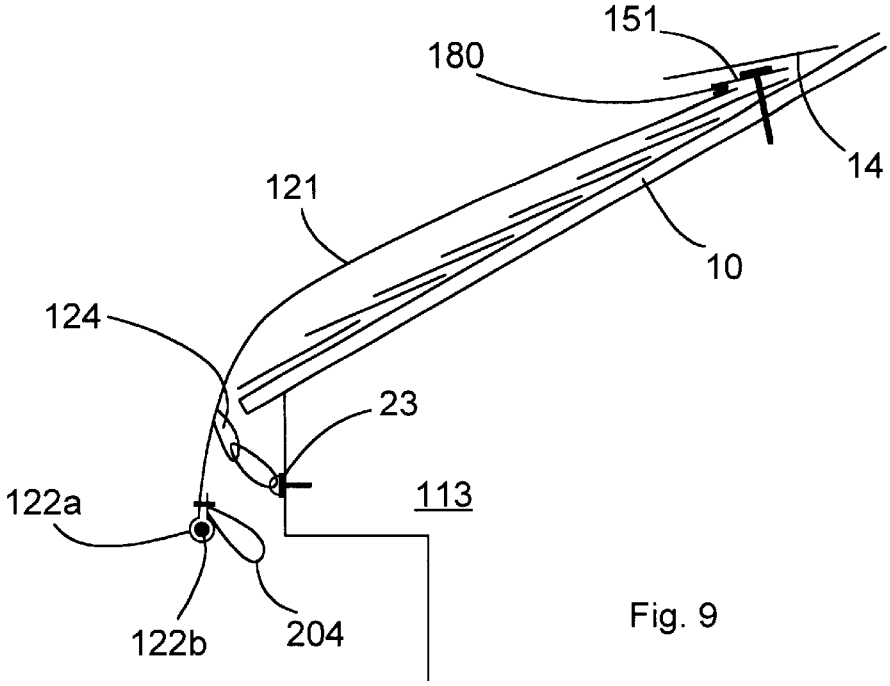
FIG. 9 is a side view of a building with a shingled roof. The figure shows the detail of a flexible shield with a weighted bottom end and pull cord assembly.

FIG. 9 is a side view of a shingled roof with a flexible cover 121 installed. A top end of the cover 121 is connected to a mounting tab 151 by a hook and loop fastening system 180. The top end of the cover 121 can be fastened directly to the roof for a more permanent installation. A bottom end 122*a* of the cover 121 is made as a loop or insert compartment to hold insert material 122*b*, such as a section of rigid rod, PVC pipe, chain, or even sand. The insert material 122*b* helps weigh down the end of the cover and to provide a more aesthetic, non-wrinkled appearance. A pull cord assembly 204 is located on the backside of the cover 121 to allow the user to manually agitate the cover 121 to help break ice and snow off of the roof 10.

Figure 10:
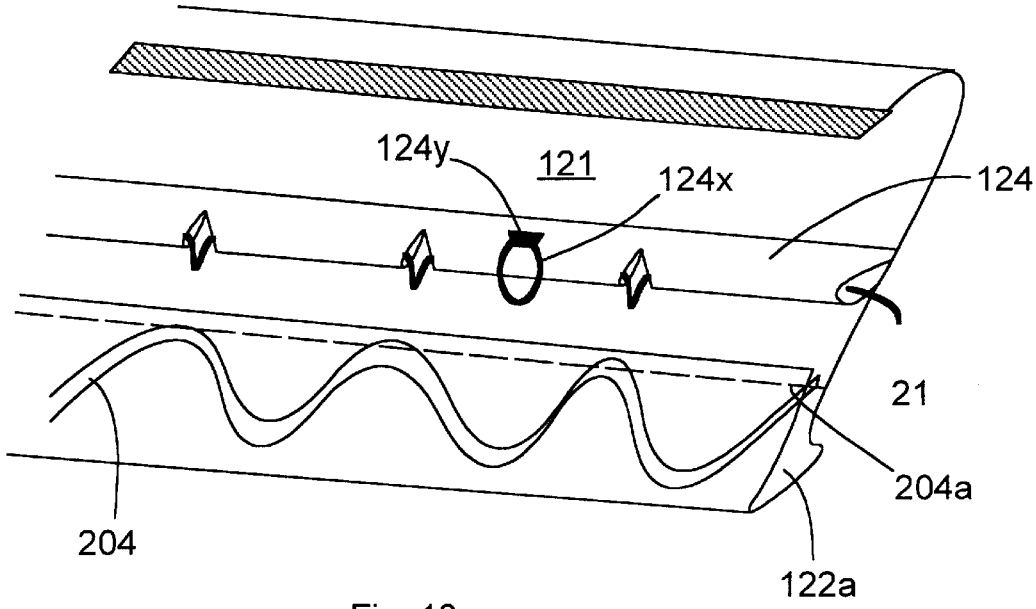
FIG. 10 shows the underside of a flexible shield (non-inflatable) with loop and bungee cord assembly. Further detail shows the pull cord assembly attached to the bottom loop on the flexible shield.

FIG. 10 is a front view of the underside of the flexible cover 121. The pull cord assembly 204, which could be made of cable, rope, webbing or fabric, is attached at approximately 46 cm intervals along the same stitch seam 204*a* as the top of the insert loop 122*a*. Further detail of the loop 124 and bungee cord 21 arrangements are shown. Individual bungee cord loop(s) 124*x* with an attachment tab 124*y* may be attached to the underside of the cover 121 in place of using the continuous cord 21. The cord 21 may be elastic or non-elastic.

Figure 11:
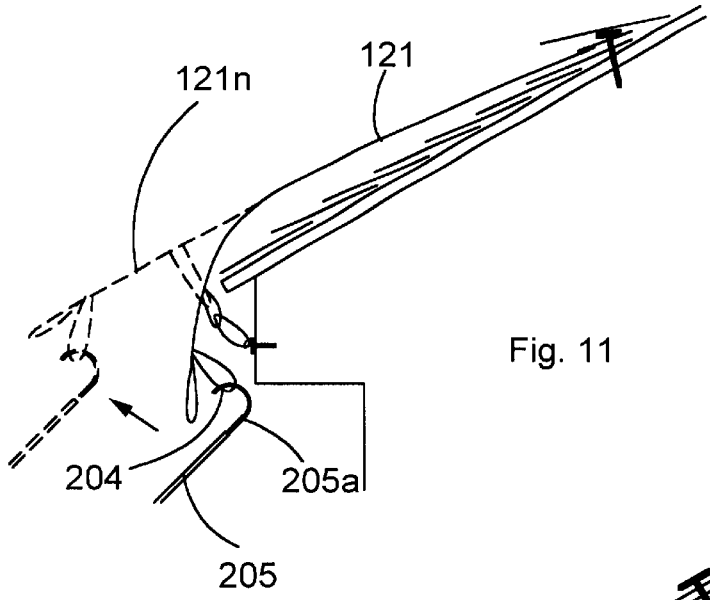
FIG. 11 is a side view of a building with the flexible shield installed. The figure shows the detail of a manually controlled hook that is connected to the pull cord assembly to agitate the lower portion of the flexible shield.

FIG. 11 shows the side view of a roof with the flexible cover 121, which may be made of an elastic material such as rubber or reinforced material such as PVC coated fabric, installed. Cover 121 materials may be fabricated using adhesives, sewing, heat-sealing, and other fastening methods well-known in the art. The user may use a rigid pole 205 with an end hook 205*a* to grab pull the cord assembly 204 to manually agitate the cover 121. Position 121*n* of the cover 121 shows the partial range of movement when the cover 121 is agitated. Although not shown in this figure, in place of using the pull cord assembly 204 and end hook 205*a* on the pole 205 to grab hold of and manually agitate the cover 121, a loop component of a VELCRO hook and loop fastening system, or other similar brands, can be installed along the bottom underside of the cover 121 in place of the pull cord assembly. The hook component can be attached to the end of the pole 205 so that when the loop component of the cover 121 and hook component on the end of pole 205 can engage to allow the user to manually agitate the cover 121 to help remove ice and snow from the roof 10.

Figure 12:
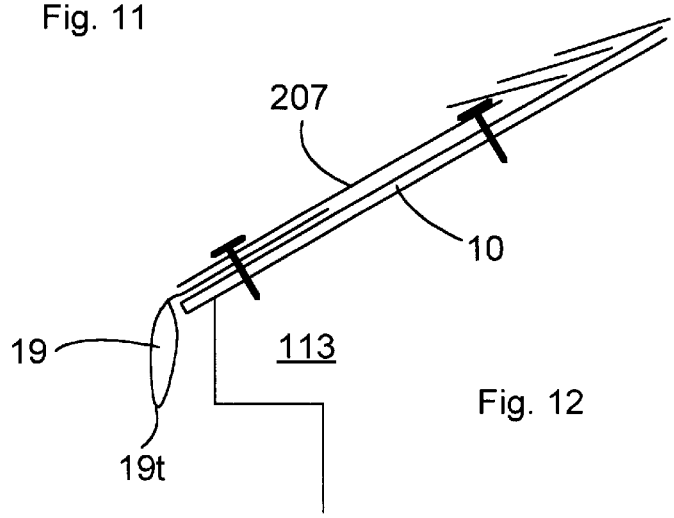
FIG. 12 is a side view of a building. The figure shows the use of rigid flashing installed at the bottom of the roof. Further detail shows the use of an inflatable sleeve device secured at the edge of the roof. (Could be just the flexible shield.)

FIG. 12 shows a rather simple configuration of the inflatable sleeve 19 sandwiched between a section of rigid flashing 207, such as stainless steel or galvanized metal sheeting and the roof decking 10. The bottom end 19*t* of the inflatable sleeve 19 may be weighted down so that it hangs down properly and does not flap in the wind. The bottom part of the inflatable sleeve 19 does not always have to be secured to the eave 113.

Figure 13:
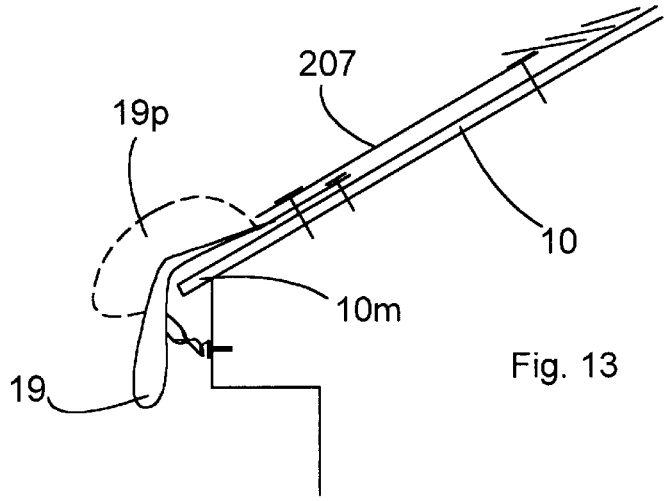
FIG. 13 is a side view of a building with a rigid shield and an inflatable sleeve mounted on the lower section of the roof. (Could be just the flexible shield.)

FIG. 13 shows another configuration of the inflatable sleeve 19 used with rigid flashing 207. In this embodiment, the inflatable sleeve is attached to the roof 10 under a bottom end of the flashing 207 and above the edge 10*m* of the roof 10. Position 19*p* shows the inflatable sleeve 19 at maximum expansion when inflated.

Figure 14:
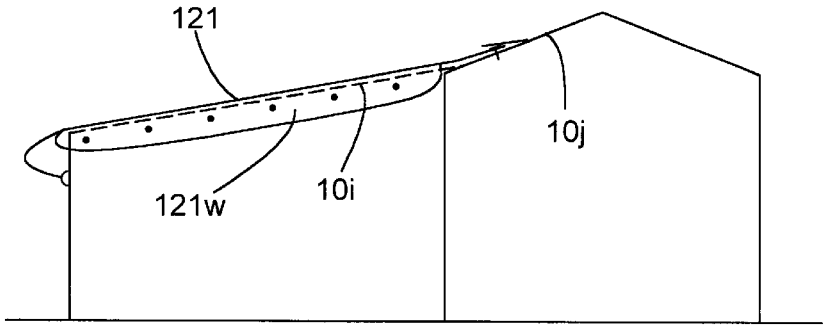
FIG. 14 shows the use of the flexible shield installed over a large area of a building's roof.

FIG. 14 shows a side view of a building with a shallow roof 10*i* and a steeper roof 10*j*. A large flexible cover 121 may be placed over the shallow roof 10*i* to prevent leaking from melting ice and snow. The cover has a slippery top surface so that ice and snow will not adhere to it. This feature protects the roof from the elements while making it easy to remove ice and snow. While snow is likely to slide off the steeper roof 10*j*, it is very likely to sit on a shallow roof, causing considerably more problems and damage. Side flaps 121*w* of the cover 121 hold the cover down, preventing wind from blowing it off.

Figure 15:
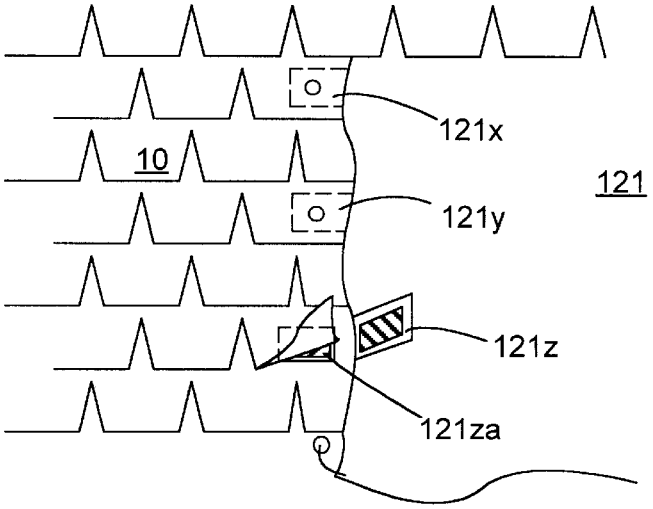
FIG. 15 is an overhead view of a flexible shield installed with end tabs secured under shingles adjacent to the end of the shield.

FIG. 15 is a top view of a shingled roof 10 showing ends tabs 121*x*, 121*y* of the flexible cover 121 placed under shingles and secured in place. Another method for holding the cover 121 ends down on the roof 10 involves equipping an end tab 121*z* with a VELCRO hook and loop fastener secured to its underside. Using the same or similar material that the cover 121 is made of, an anchor tab 121*za* is permanently fastened under a shingle to the roof 10. The end tab 121*z* can be easily secured to the roof 10 under a shingle to anchor tab 121*za* so that removal and reinstallation of the cover 121 can be performed easily. Securing the ends of a cover or sleeve using end tabs is another method of installing the present invention.

Figure 16:
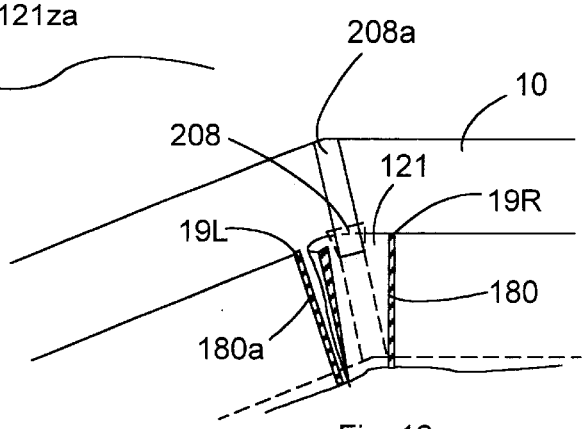
FIG. 16 is an overhead view of a sectional piece of the flexible shield used in a roofs valley section.

FIG. 16 is a top view of the roof 10. A flexible, non-inflatable cover 121 is used in the valley section of the roof 10, to provide a continuing cover surface connecting adjoining inflatable sleeves 19R and 19L. The top, left vertical end of the sleeve 19R and the top right vertical end of the sleeve 19L are equipped with a hook component of a VELCRO strip. The valley cover 121 sections vertical ends are equipped with the loop components strips. Attaching the valley cover 121 to both inflatable sleeves 19R and 19L is made by a connection 180. Lower valley flashing 208 is adhered to upper valley flashing 208*a*, enabling the top end of the cover 121 to fit underneath and allowing valley runoff to flow over the lower flashing 208 and the cover 121. This feature of the invention makes it possible to join several sections of the device in a modular fashion. This is helpful because most buildings to not have a single, continuous length of roof, but are varied in height and direction to suit architectural demands.

Figure 17:
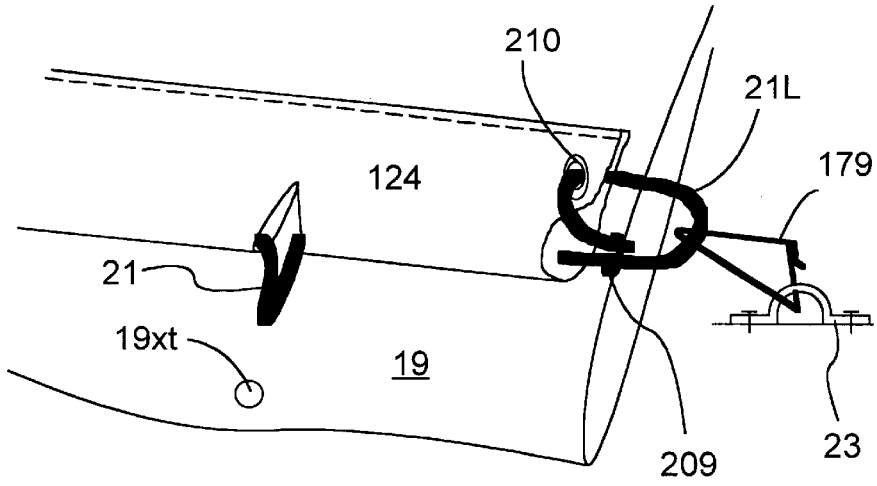
FIG. 17 is an overhead view showing the underside of the end of an inflatable sleeve component. The figure shows the detail of the end of the bungee cord configuration fixed to a grommet in the end of the sleeve. The bungee cord loop is shown pulled away from the sleeve and secured to a mounting bracket using a cable tie.

FIG. 17 is a top view showing the detail of the bottom underside bungee assembly of the inflatable sleeve 19. To keep outward and lateral tension on the opposite ends of a bungee loop assembly 124, a bungee cord 21L is passed though an opening 210 (grommet) and made into a loop by securing a locking clip 209 on the bungee cord 21. The bungee cord loop 21L is secured to the hook 23 using a cable-tie 179. Both the bungee cord 21 and loop assembly 124 are pulled outward using the loop 21L in conjunction with the hook 23 and cable-tie 179 components. The outward and lateral tension keeps the invention taut, wrinkle-free, and secured properly to the roof. It comprises an addition step in the method of installing the invention, that of providing lateral tension in the bottom of the device using a loop of cord at each end with is secured to the roof beyond the edge of the sleeve or cover. Use of a bungee cord or other elastic material and devices such as a spring allows upward movement of the inflatable sleeve 19 as it is inflated and aids in pulling the inflatable sleeve back in position during deflation and for holding the cover securely against the roof. The air pressure required to inflate the inflatable sleeve 19, even when a heavy loading of ice and snow exists, generally requires less than about 35 kPa. An air inflation means such as a pump, blower, or even a leaf blower, is pneumatically attached to the sleeve to via an air inlet fixture to inflate the sleeve. A bungee cord loop 21L may be connected directly to the hook 23 instead of using a cable tie 179 to provide extra adjustment. A small opening 19*xt* (approximately 3.2 mm diameter), that can even be a simple puncture, may be applied to a bottom edge on the underside of the inflatable sleeve 19 to allow moisture to drain out of the sleeve.

Figure 18:
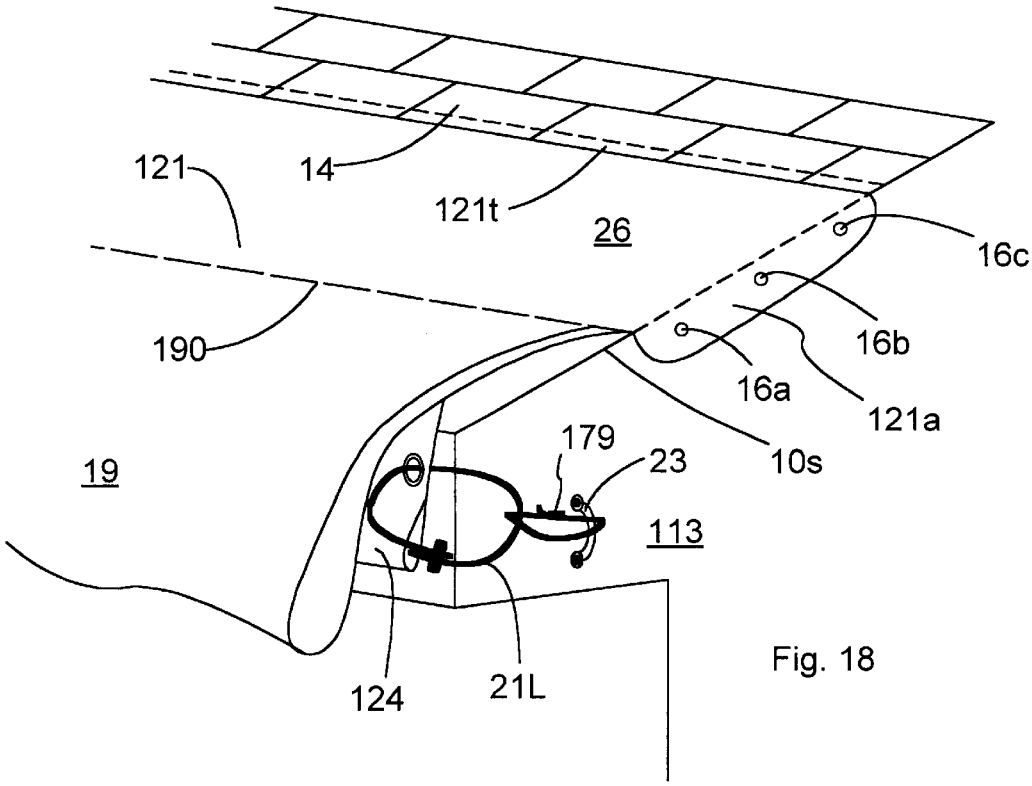
FIG. 18 is a bird's eye view of the inflatable sleeve installed on the end of a roof. The figure shows how the loop assembly is pulled taught and secured to a mounting. bracket on the eave of the building.

FIG. 18 is a bird's eye view showing further detail of the right end of the bungee cord 21 and loop assembly 21L secured to the eave 113 of a building. A cable-tie 179 is used because it can be adjusted easily to the desired length during installation. To prevent winds from getting under the invention at the ends of a roof and causing damage, an end flap 121*a* is extended over the roof edge 10*s* and secured to the side of roof with fasteners 16*a*, 16*b* and 16*c*. The end flap 121*a* extends between the flexible cover's top end 121*t* at the shingle 14 downward to the inflatable seam 190. The flap 121*a* is actually an extension of the non-inflatable section 26 of the cover 121. Providing an end flap is a method to hold down the system at its edges to prevent wind from pulling it up and causing damage.

Figure 19:
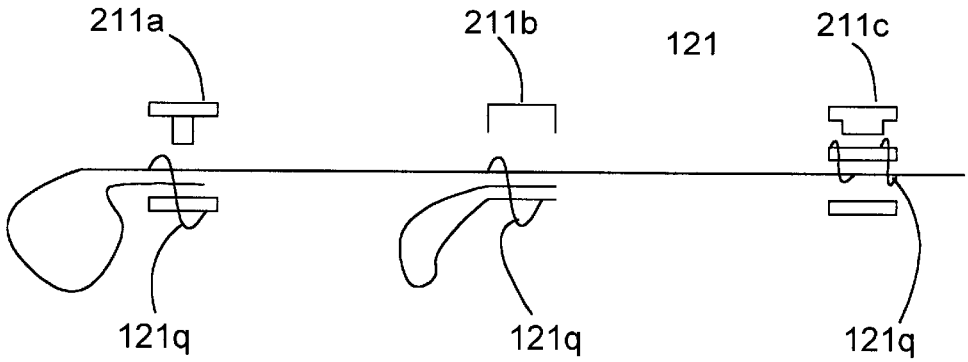
FIG. 19 is an end view of various methods for securing the stitching when the flexible sleeve is cut to size.

FIG. 19 is an end view of the cover 121 showing three methods for securing or binding the loose stitching ends 121*q* when the cover 121 is measured and cut to size. It is an advantage of the present invention that the sleeves or covers can be manufactured in long, continuous lengths and cut to size on site. A rivet 211*a*, a staple 211*b* and a grommet 211*c* are used respectively to lock down the cut end seams of different plies and components of the cover 121 as well as the loose stitching ends 121*q* that occur after cutting. These fasteners lock down the various plies, stitching 121*q* and materials used in the cover 121 and inflatable sleeve so that they can not unravel and come apart.

Figure 20:
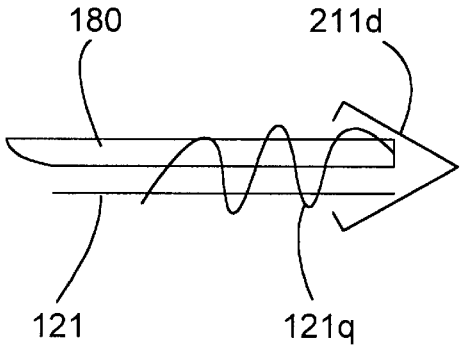
FIG. 20 is a side view of an end clasp being affixed to the end seam of the flexible cover and Velcro, locking the stitching and components down and tight.

FIG. 20 shows an end clasp 211*d* in place at the end of a seam. The clasp 211*d* can be metal or plastic and pressed, heated, melted or locked into position as desired. The end clasp 211*d* locks together ends of a VELCRO strip 180, stitching end 121*q* and cover fabric 121.

Figure 21:
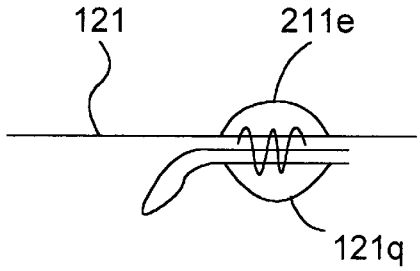
FIG. 21 is an view of the flexible sleeve and loop assembly with the stitching held in place with glue.

FIG. 21 is end view of a cut off seam involving two plies of the flexible cover 121 and stitching end 121*q* using adhesive 211*e* to hold ends together.

Figure 22:
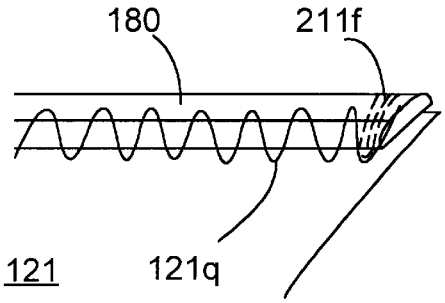
FIG. 22 is a bird's eye view of the end of the Velcro strip and flexible cover. The end stitching is held in place by cross stitching over the end seam.

FIG. 22 is a bird's eye view of the cover 121 that has been recently cut to size. A VELCRO strip 180, stitching 121*q* and cover material 121 are joined together by cross stitching 211*f*.

Figure 23:
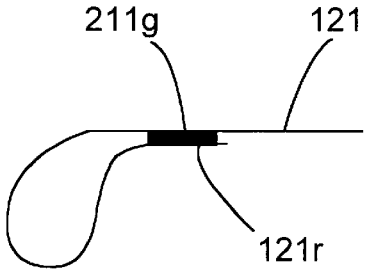
FIG. 23 shows a seam that is heat sealed or glued without the use of stitching.

FIG. 23 is an end view of a seam 121*r* formed by folding over the cover 121. The seam 211*g* is formed by heat sealing.

Figure 24:
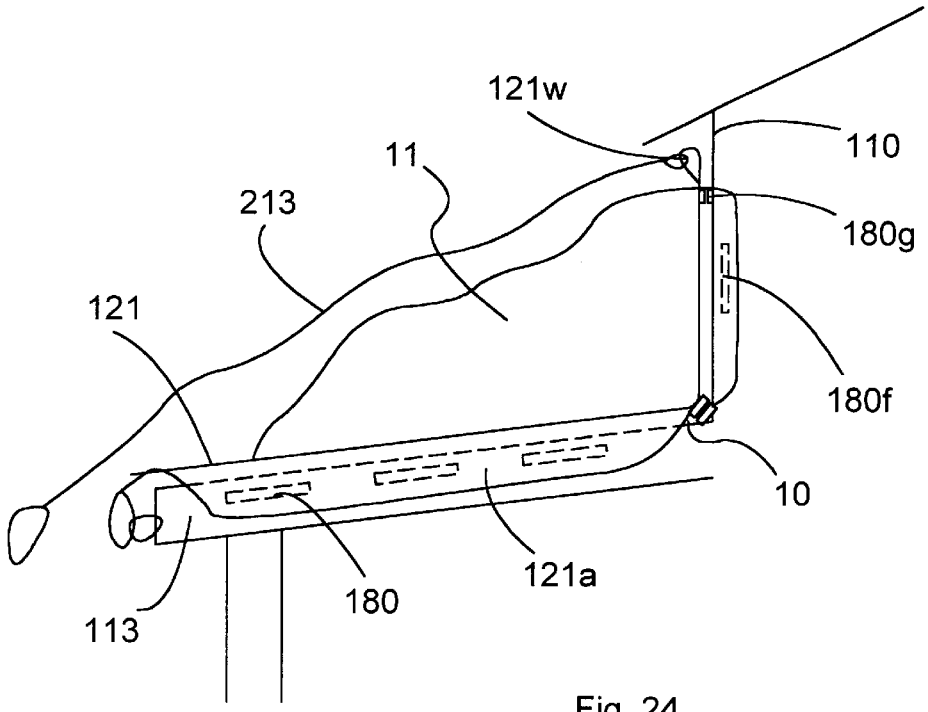
FIG. 24 is a side view of a building having a lower roof section that is sloped very shallow. A flexible shield is installed so that the snow may be removed by pulling the top straps on the shield.

FIG. 24 is a side view of a building with a shallow sloped porch area where snow 11 typically collects. A flexible cover 121 provides a waterproof barrier over the roof 10. The flexible cover 121 is held down on the sides of the roof using an end flap 121*a* and a VELCRO connection 180 between an interior surface of the end flap 121*a* and an eave area of roof 113. The front end of the cover 121 is held to the front of the eave 113 by a standard fastening means of the invention. At the rear bottom corner of the roof 10, a VELCRO connection 180*f* is used to hold the corner of the cover 121 secured to the corner of the roof 10. A VELCRO connection 180*g* is used in a similar manner to hold the back, top end of the cover 121 to a building sidewall 110. Cover straps 121*w* may be pulled by attaching a rope 213 by any suitable means, such as manpower, a winch, truck, etc., to remove the snow off the roof 10.

Figure 25:
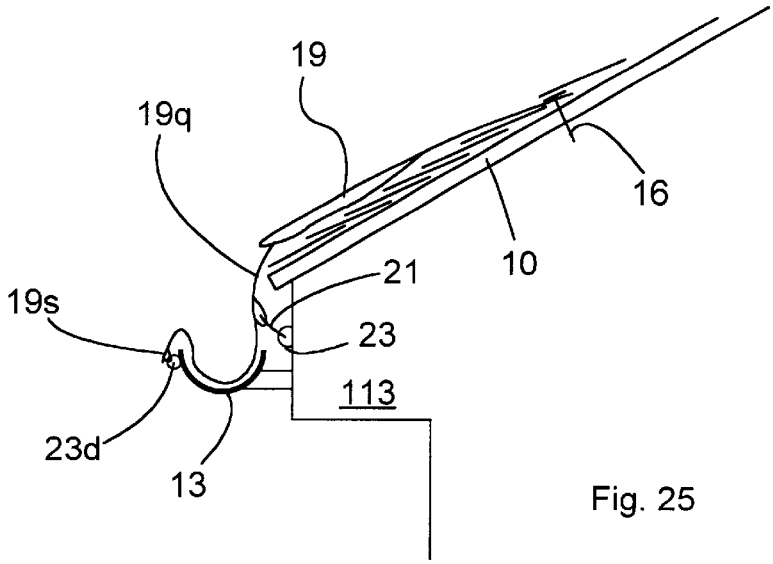
FIG. 25 is a side view of a building with a gutter installed on the eave. A non-inflatable end section of the inflatable sleeve is provided to lay in the gutter so that the gutter remains functional.

FIG. 25 is a side view of a roof showing an end flap 19*q* from the bottom of the inflatable sleeve 19 held down by a shock cord 21 and a hook 23 so that the end flap 19*q* rests in a gutter 13 so that gutter remains functional while the invention is in use. The end 19*s* of the end flap 19*q* is secured to the front exterior of the gutter by a hook 23*d*. Any suitable means of attachment may be used to secure the end 19*s* of the end flap 19*q* to the gutter 13. The gutter can act as a brake to hold snow and ice of the roof and keep it from falling until the system is operated. This feature adds to the safety of the system. This version provides a method both clean out the gutter and to remove ice and snow from a roof.

Figure 26:
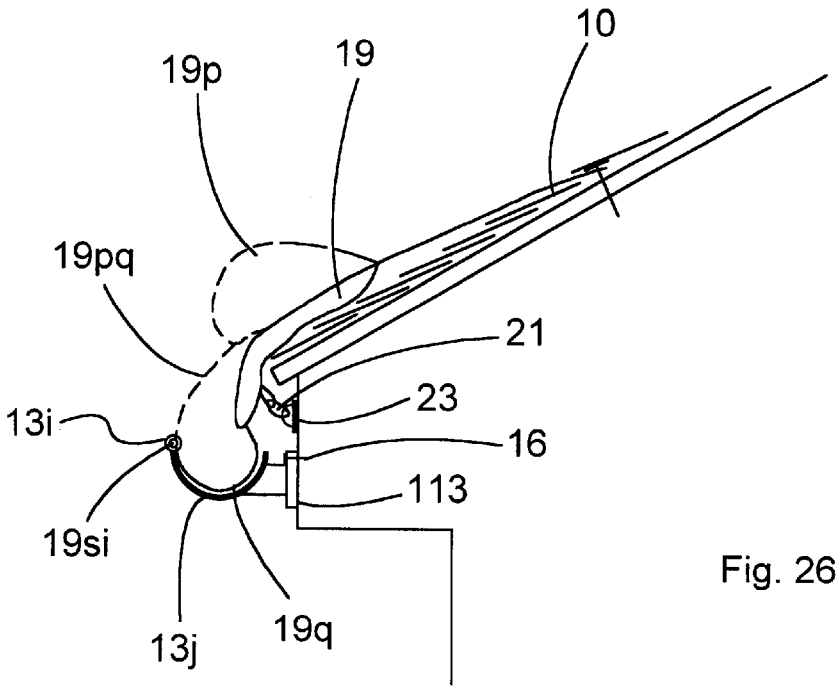
FIG. 26 shows an inflatable sleeve having a non-inflatable section that lays in a gutter that acts to empty the gutter when the sleeve is inflated.

FIG. 26 is a side view of a roof 10 showing an end flap 19*q* anchored to an end ring 13*i* of a support fixture 13*j* as the end flap 19*q* extends from the bottom of an inflatable sleeve 19. The end flap 19*q* and inflatable sleeve 19 are also secured to the eave by attaching a shock cord 21 to a hook 23 on the eave 113. The support fixture(s) 13*j* are affixed to the eave approximately every 61 cm to 91 cm to provide adequate support to a rod 19*si* containing with a loop on the end of the end flap 19*q*. When the inflatable sleeve 19 is deflated, end flap 19*q* forms a flexible gutter component. When the inflatable sleeve 19 is inflated, as shown by inflated position 19*p*, the end flap 19*q* is raised from its rest position, functioning as a gutter, to an almost vertical position 19*pq* so that the contents of the gutter (not shown) such as ice, snow, dirt, and water, are automatically removed. The support fixture 13*j* is similar in design to an actual gutter support and is secured to the eave 113 with a fastener 16. As ice and snow melts during the day, after the inflatable sleeve 19 is inflated to remove ice and snow from the roof 10 and raises and cleans out the end flap 19*q*, the end flap resumes its function as a gutter to catch dripping ice and snow runoff from landing on the ground and may refreeze, causing a hazardous condition. After inflation, a bungee cord 21 helps pull the end flap 19*q* and inflatable sleeve 19 back into position. This configuration of the invention provides the ability to perform as a gutter in addition to removing ice and snow from a roof. The need for a rigid gutter trough is eliminated. The gutter also functions as a brake to hold snow and ice onto the roof until the inflatable sleeve is inflated. When inflated, the gutter no longer operates as a brake and ice and snow fall to the ground at the command of the operator.

Figure 27:
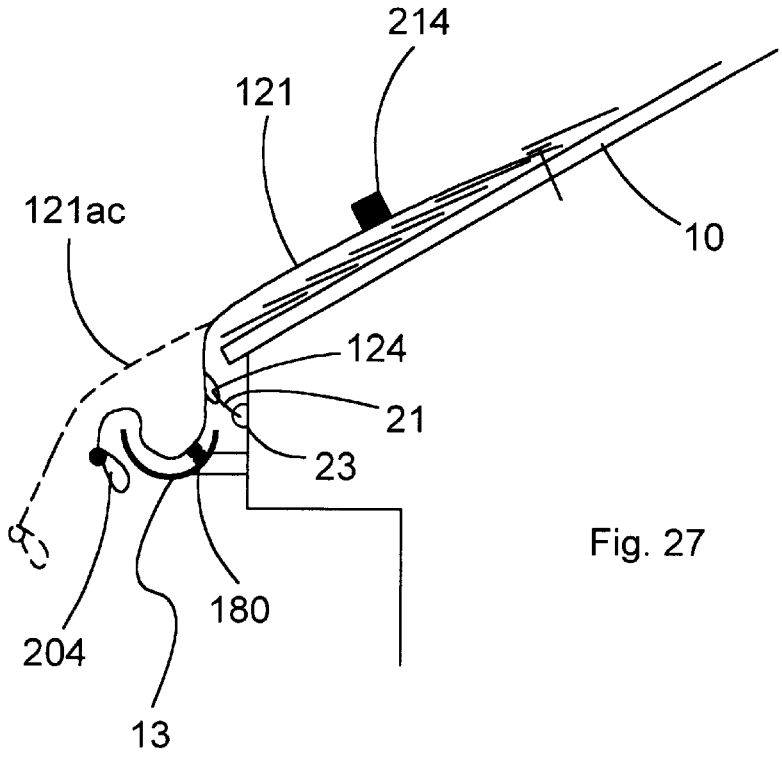
FIG. 27 is a side view of the flexible cover installed on a building's roof. The bottom end of the shield has a pull cord assembly so that the end of the shield can be pulled so that it lifts out of the gutter. A cleat is also shown mounted on cover to hold ice in place until shield is agitated.

FIG. 27 shows a side view of a roof section with further detail showing the use of the flexible cover 121 held in the gutter by a VELCRO connection 180. A pull cord assembly 204 can be used to agitate the cover 121 to help remove snow and ice from the roof 10. A fastening assembly using a bungee cord 21 helps restrain the cover 121 in its proper position. A cleat 214 may be attached to the cover 121 or the inflatable sleeve to hold ice formations of the roof 10 until the unit is inflated or manually agitated. The cleat 214 may be fastened through the cover 121 or adhere to the top surface. When inflated or agitated, ice and snow will most likely free itself from the cleat.

Figure 28:
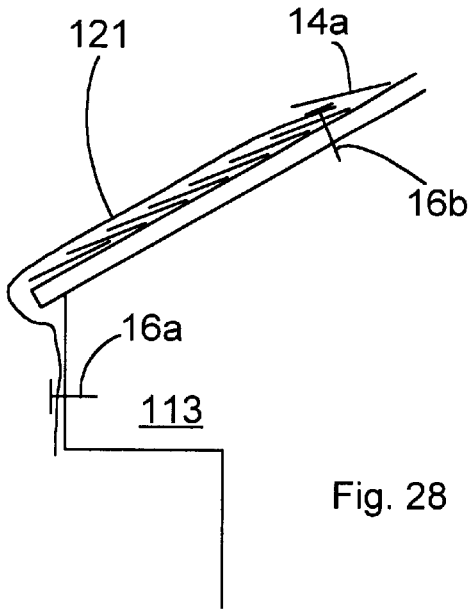
FIG. 28 is a side view of a building's roof section. The top end of the flexible shield is shown affixed under a shingle on the roof while its bottom end is fastened to the edge of the roof.

FIG. 28 is a side view of a roof 10 with a flexible cover 121 attached on the roof surface 10 with a fastener 16*b* under a shingle 14*a* extending downward and attached on the eave 113 of the roof 10 with a fastener 16*a*. The top side of the cover is a slippery, non-stick surface that facilitates the removal of ice and snow.

Figure 29:
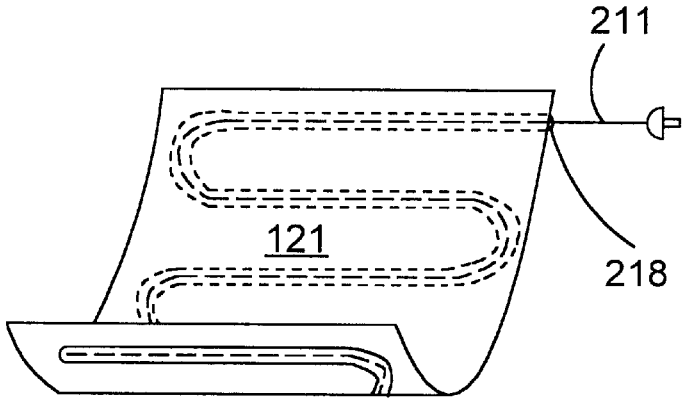
FIG. 29 is a bird's eye view of a flexible shield section with heat tape mounted and held in place by a pocket type cover on the back side of the shield.

FIG. 29 is a bird's view of a section of the cover 121 showing a heat wire 211 enclosed in a compartment 218 on the underside of the cover 121. Snow typically has a strong grip on shingles where heat tape is used, allowing substantial amounts of snow and ice to remain and form on a roof while the heat wire is in operation. The heat tape, in conjunction with the smooth and slippery surface of cover 121 will allow greater amounts of ice and snow to be removed from a roof. When large chunks of ice do fall, the heat tape will not be pulled off the roof as is so commonly seen with the use of heat tape. This also makes it very easy to install heat tape.

Figure 30:
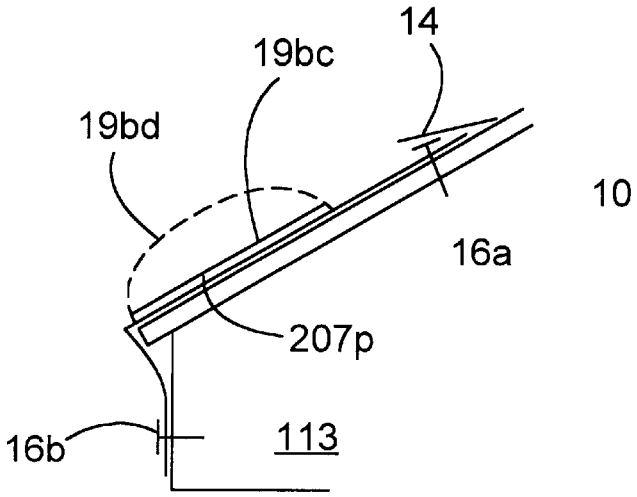
FIG. 30 is a side view of a roof section with an inflatable sleeve using an elastic fabric material. In this embodiment, the elastic inflatable sleeve is attached to a rigid mounting plate.

FIG. 30 is a side view of a roof 10 with elastic inflatable cover 19*bc* mounted on a sheet 207*p*. The sheet 207*p*, which may be rigid or flexible, is secured to roof under a shingle 14 with a fastener 16*a* and secured at the bottom to the eave 113 with another fastener 16*b*. In fact, any of the sleeves and covers described can be made of either elastic or inelastic materials.

Figure 31:
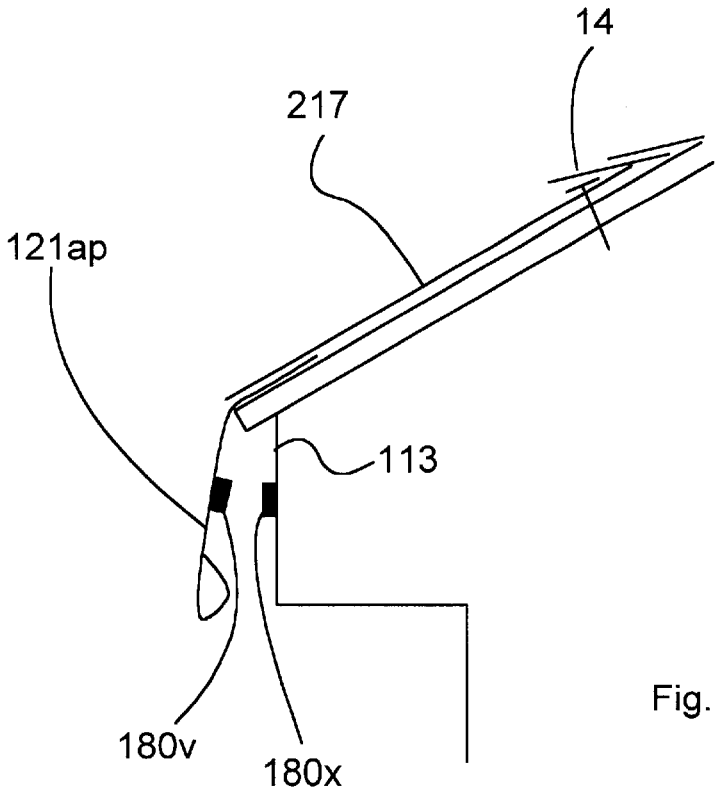
FIG. 31 is a side view of the building's roof with a flexible cover installed under the bottom end of flashing.

FIG. 31 is a side view of a building's roof with flashing 207 installed over the lower section of a roof 10. A flexible cover 121*ab* is installed under the bottom end of the flashing 207. A cover hangs downward to keep ice from forming on eave 113. The cover 121*ap* can be made in several other configurations such as an inflatable sleeve, elastic material, etc. The cover 121*ap* can be equipped with a pull cord assembly for manual agitation. In almost all of the configurations of the flexible cover, the bottom side closest to the edge can be manipulated from behind with the user pushing the cover from a window or balcony. Another embodiment of this invention uses a VELCRO hook and loop fastener 180*v* and 180*x* to removably fasten a back side of the cover 121*ap* to the eave 113. No bungee cord is required in this configuration. The flashing prevents ice buildup on the eave.

Figure 32:
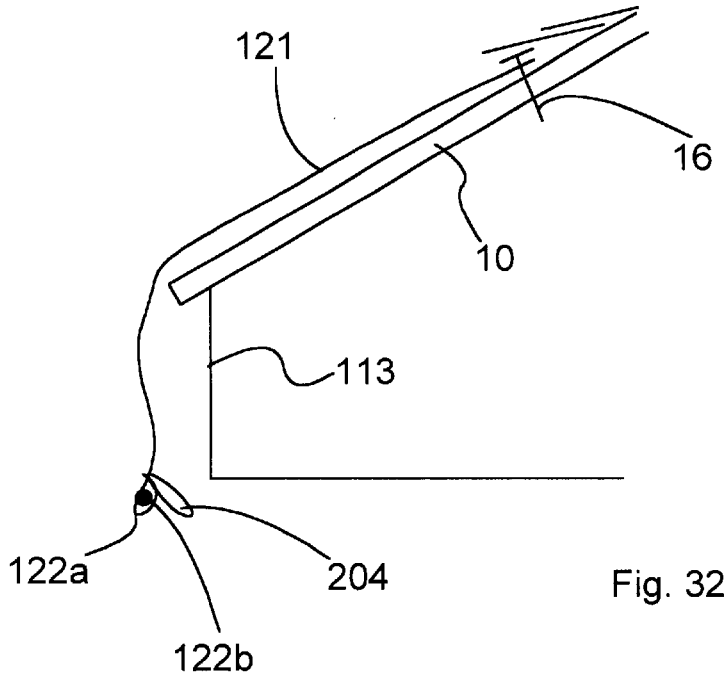
FIG. 32 is a side view showing a flexible shield affixed to an eave with a hook and loop fastening assembly and weighted end.

FIG. 32 shows a cover 121 fastened to a roof 10 with a fastener 16. The cover 121 hangs down over the edge of the roof 10. A bottom end 122*a* of the cover is folded to form a space that can contain material 122*b* to hold down the bottom end so that it will not be blown out of its proper position by the wind. The material 122*b* can be sand, PVC pipe, or any convenient material. A pull cord assembly 204 is provided and is secured near the bottom end 122*a*.

Figure 33:
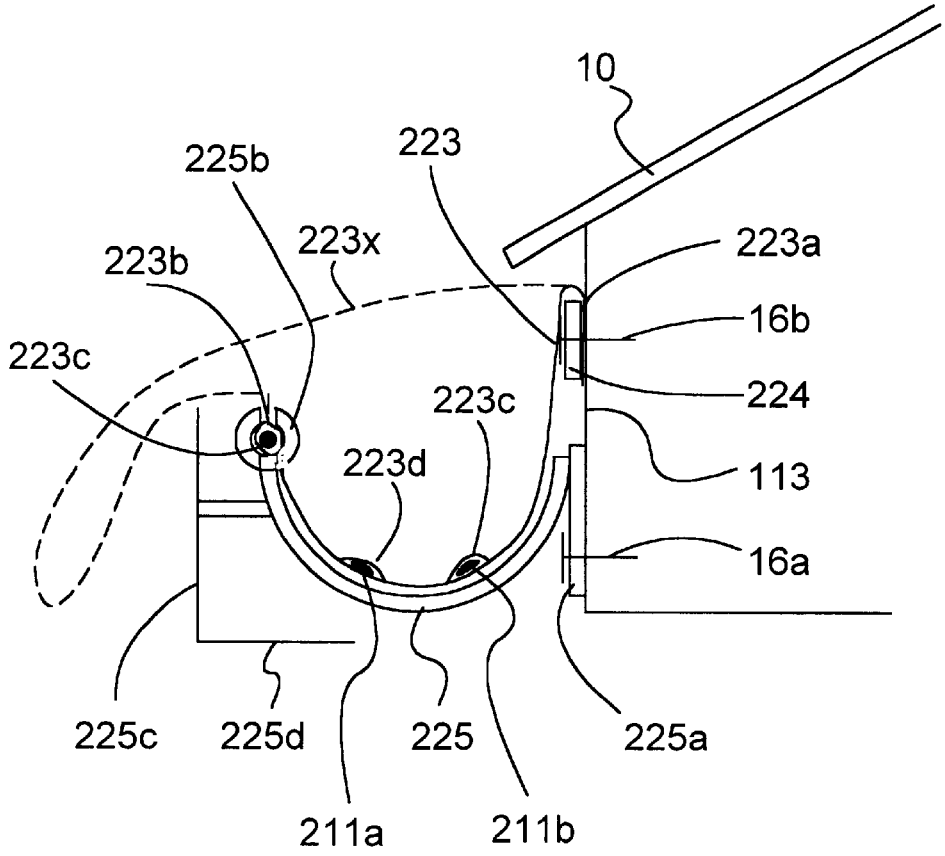
FIG. 33 is a side view of roof with a flexible gutter.

FIG. 33 is the side view of a building's lower roof 10 and the eave 113 area showing detail of a flexible gutter 223. A top end 223*a* of the flexible gutter is sandwiched between a clamp bar 224 and the eave 113 surface with a fastener 16*b*. A support frame 225 is attached to the eave 113 by inserting the fastener 16*a* through a support frame flange 225*a*. The support frame 225 may be attached to the eave 113 at intervals of approximately 46 cm along the eave 113. An outward end loop 223*b* of the flexible gutter 225 may have an insert support 223*c*, such as an about 6.4 mm diameter plastic or metal rod, installed to hold the gutter in an open position. An end bracket 225*b* will hold the insert support 223*c* firmly in place. A face plate 225*c* and a bottom corner plate 225*d* may be added to the support frame 225 to provide a more standard and aesthetically-pleasing appearance to the flexible gutter 223. Bottom openings between the support frames 225 enable a person to push the bottom of the flexible gutter 223 upwards for clean-out purposes. The flexible gutter 223 is shown and at extended and raised position 223*x*. Flexible insert openings 223*d* and 223*e*, fabricated by using two plies of material, may be added to the flexible gutter 223 with heat tape 211*a* and 211*b* installed to help melt ice and snow that forms in the flexible gutter 223. Any suitable means, such as a VELCRO fastener, can be used to hold the ends 223*a* and 223*b* of the flexible gutter 223 secured in a proper position on the eave 113. VELCRO and other fastening components may be used to hold the flexible gutter 223 in a folded or extended position. The flexible gutter may or may not be provided with an aesthetic facade. When the flexible gutter is pushed upward from its bottom its shape goes from substantially concave to substantially convex, thereby emptying any ice, snow, or debris that may have accumulated within the gutter.

Figure 34:
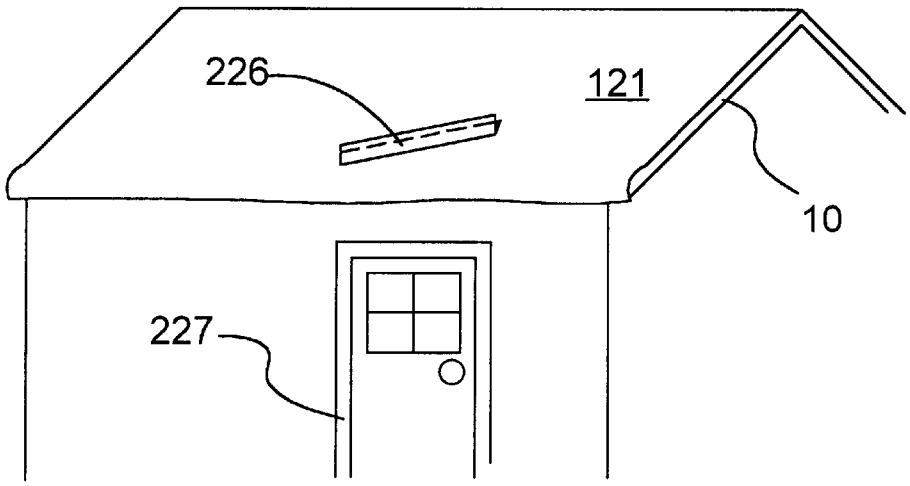
FIG. 34 is a view of a roof with a cover and water diverter secured over the cover.

FIG. 34 is a bird's eye view of a building with a flexible shield 121 installed on the roof 10. A water diverter 226 may be made of any substantially rigid material such as light weight aluminum, steel or plastic angle or similar structural material. The water diverter 226 may be attached directly to the flexible shield 121 using rivets, adhesives, sealants, hook and loop fasteners, screws, or other fasteners. If a permanent diverter is already or about to be installed directly on the roof surface 10, a pocket (not shown) may be formed and fabricated on the cover 121 for the diverter to fit into and not damage the underside of the cover 121. The cover 121, in addition to being an apparatus for removing ice and snow, also has the benefit of forming a water-proof cover to the roof 10 and preventing damage from exposure to moisture.

Figure 35:
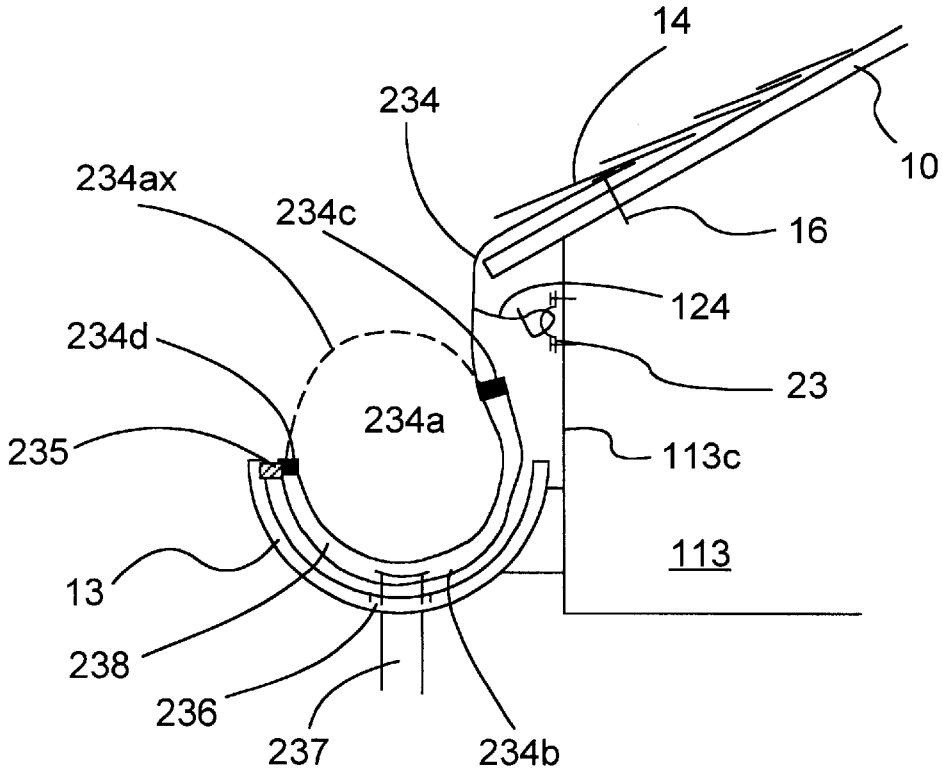
FIG. 35 is a side view of an embodiment of the present invention adapted to remove ice, snow, and debris from a gutter using an inflatable sleeve.

FIG. 35 is a side view of the roof 10 showing a flexible cover 234 secured to the roof 10 under the bottom row of shingles 14. The flexible cover 234 can be made of a non-reinforced rubber, vinyl or plastic sheeting and may be elastic or as a rubber, vinyl or plastic coated fabric. Bottom flap 234*b* ends are secured by an adhesive, sewing, heat sealing or clamping to the cover 234 at locations 234*d* and 234*c*, forming an inflatable compartment 238. The bottom flap end 234*b* is fastened to an outside edge of a gutter 235 by using an adhesive, VELCRO or clamping means. The gutter 13 cradles and supports the cover 234, with an inflatable compartment 238 so that runoff moisture, rain, ice, snow, leaves and other debris cannot contact and damage the sidewall 113*c* of the eave 113. The sidewall 113*c*, gutter 113 and fasteners that hold the gutter 113 to the eave 113 are kept dry and out of the elements, preventing rusting of metal parts and other damage to eave such as paint flaking, rotting wood and other water damage. A hose 237 may be passed through a hole 236 in the gutter 113 and connected to the inflatable compartment 238 to provide an air source for inflating and expanding the inflatable compartment 238. A leaf blower may be used to inflate cover 234. At full inflation a cover 234*a* pushes upward, removing ice, snow, leaves, dirt, water and other debris, making the gutter 13 operational. Location 234*x* shows the cover 234*a* at full inflation. The bungee or non-elastic cord 124 may be secured to the hook 23 to provide extra hold down support to the cover 234. An inflation hose may be secured to a gutter downspout.

Figure 36:
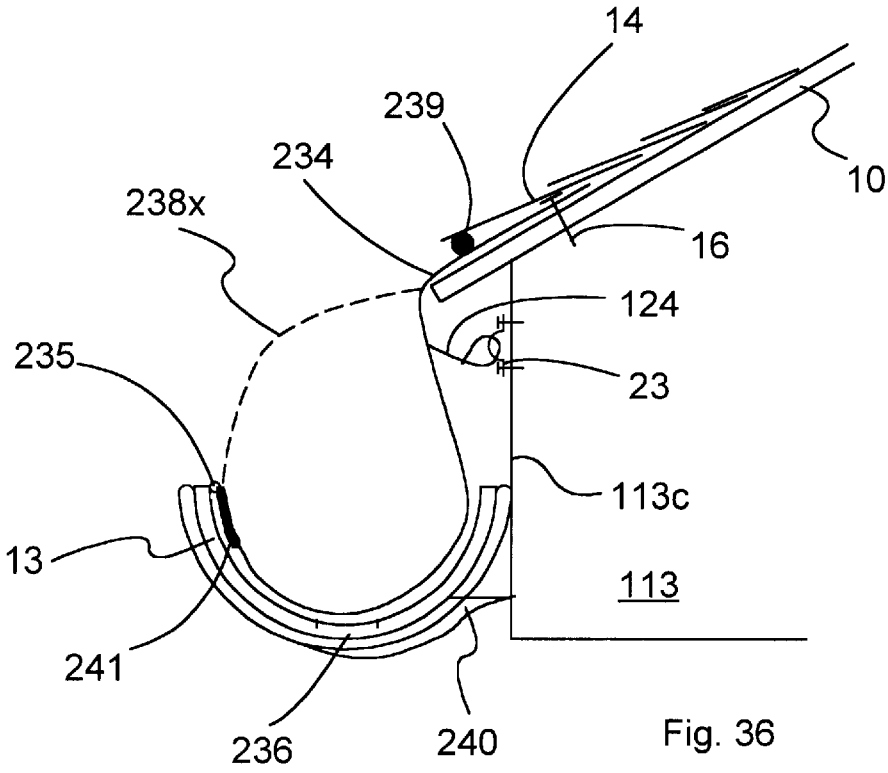
FIG. 36 is a side view of an embodiment of the present invention adapted to remove ice, snow, and debris from a gutter using a manual agitation.
Figure 37:
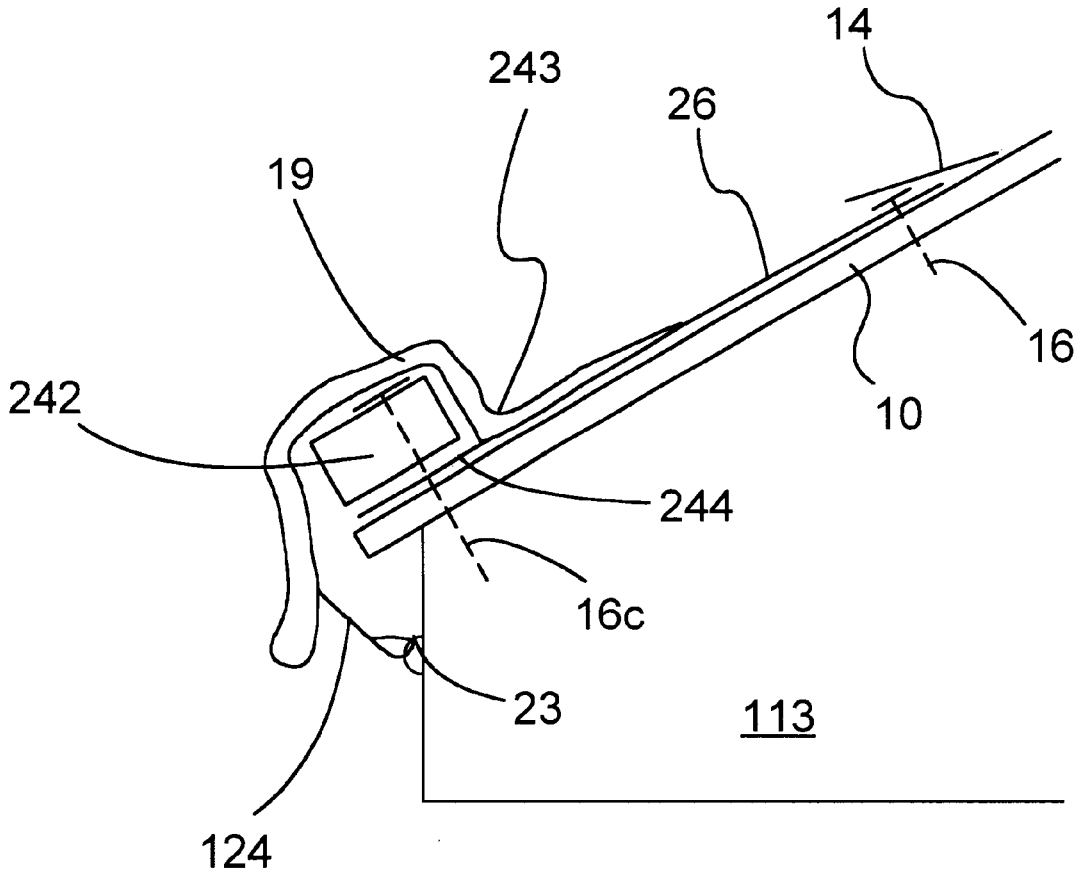
FIG. 37 is a side view of a roof with a fence feature for preventing ice and snow from sliding off the roof.

FIG. 36 is a side view of the roof 10 showing the flexible cover 234 secured to the roof 10 under the shingle 14. A top end of the cover 234 may be glued, stapled, or fastened to the roof 10 with a screw 16. Caulk or adhesive 239 may be applied on a top surface of the cover 234 to hold the shingle 14 against the roof 10, especially for installations that may be subject to high wind conditions. The bottom end of the flexible cover 234 is attached to the gutter 13 at location 235. The hole 236 in the gutter 13 may be used to allow one to use a broom handle or other stick like object to raise the cover 234 upward to location 238*x* to remove water, snow, ice, leaves, branches and other debris from the gutter 13. The cord 124, which may be elastic, will help hold the cover 234 in place in the gutter 13 if used with the cover 234. The cover 234 prevents water from freezing and expanding between the sidewall 113*c* and the gutter 13, which can cause damage to the gutter 13 and the eave 113. The cover 234 may be held in place with gutter mounting fixture(s) 240 fastened to the eave 113 and used without the support of the gutter 13. In effect, the version in FIG. 116 does with the use of a stick like object what the version in FIG. 115 does with inflation. A porous material 241 is disposed between the gutter 13 and cover 234 to enable caulk or other adhesive to adhere to materials like metal and vinyl. Mesh or porous material 241 can be attached to cover 234 during manufacturing FIG. 37 is a side view of a roof 10 showing a top non-inflatable section 26 of an inflatable sleeve 19 secured to the roof 10 under the roof covering (shingle, panel-type roofing, tile or membrane type) 14 with a fastener 16. A fence 242, which may be made of wood, plastic, metal or other building materials is fastened to a bottom section of the roof 10. The fence 242 acts as an obstruction along the roof surface to help prevent snow and ice from sliding off the roof 10 and causing damage or injury below. This is especially a major problem with panel type roofs because snow and ice can easily slide down their slippery surface. A tab 244 extends from the underside of the inflatable sleeve 19 and may be sandwiched between the fence 242 and roof 10 or otherwise anchored in position. As snow, water, ice and other debris collects in the trough 243 and against the fence 242, an operator may inflate the inflatable sleeve 19, which as it expands upward will lift material in the trough 243 at a level higher than the fence 242, allowing it to be removed from the roof 10. A shock cord 124, or other elastic material, is connected to a hook 23 on the eave 113 so that the bottom end of the inflatable sleeve 19 is able to move as it is inflated while being held secure to the eave 113. The fence forms a gutter and brakelat once.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

I claim:

1. An apparatus for removing ice and snow from panel roofs comprising a substantially rigid insert (173) secured to a roof (10), and a flexible cover (121) having a top end and a bottom end, said top end secured to the insert, and said bottom end secured below a bottom edge of the roof, such that ice and snow built adhering to the lowest portion of the roof is fractured by the agitation of the flexible cover and falls away from the roof in a controlled manner.

2. The apparatus of claim 1 further comprising a flexible cover (121) having a top end, a bottom end (122*a*) opposite said top end, a top side, and a bottom side opposite said top side, said top edge secured to a roof (10); and a loop arrangement (124), said loop arrangement comprising a plurality of individual loops (124*x*) each secured to a respective attachment tab (124*y*), said attachment tab secured to the bottom side of the bottom end (122*a*) of the cover (121), such that the loop arrangement is adapted to be secured to an eave (113) by a fastener through said loops (124*x*) to prevent the cover from being dislocated by windy weather.

3. An apparatus for removing ice and snow from roofs comprising a flexible cover (121) having a top end, a bottom end (122*a*) opposite said top end, a top side, and a bottom side opposite said top side, said top edge secured to a roof (10); and a bungee cord arrangement comprising a flexible material folded and secured to the bottom side of the cover (121)

substantially parallel to and between the top end and the bottom end (122*a*) to form a compartment, said compartment having a plurality of openings through which loops from a continuous length of bungee cord (21) can pass through and is suitably adapted to receive a fastener (23) to secure the cover (121) to an eave (113) to prevent the cover from being dislocated by windy weather and to provide lateral tension to the bottom end of the cover.

4. The apparatus of claim 2 or 3 further comprising a pull cord assembly (204), said pull cord assembly comprising a loop means suitably adapted to receive a hook (205*a*) so that an operator manually agitating the cover (121) will break loose ice and snow disposed on the top side of the cover in a controlled manner.

5. An apparatus of claim 2 further comprising at least one end tab (121*x*) along a side of the cover (121) adjacent to the top end and the bottom end such that in use the end tab is secured between a shingle and a roof (10).

6. An apparatus for removing ice and snow from valley sections between two sections of roof (10) comprising two inflatable sleeves (19R) and (19L) secured substantially parallel to the roof line of two respective roof sections each having a connection (180) at a side nearest a valley between two roof sections, said connection comprising a hook component of a hook and loop fastener, and a flexible cover (121) disposed on the roof (10) substantially between the inflatable sleeves (19R) and (19L) and underneath a lower valley flashing (208) on the roof (10), said cover (121) having a corresponding loop component of a hook and loop fastener to complete connection (180), such that ice and snow are directed over the lower flashing and cover (121) and thus forming a modular ice and snow removal system.

7. An apparatus for removing ice and snow from panel roofs comprising a substantially rigid insert (173) secured to a roof (10), and an inflatable sleeve (19) having a top end and a bottom end, said top end secured to the insert, and said bottom end secured below a bottom edge of the roof, such that ice and snow built adhering to the lowest portion of the roof is fractured by the inflation of the inflatable sleeve and falls away from the roof in a controlled manner.

8. The apparatus of claim 7 further comprising a mounting fixture (108*a*) secured to a sidewall (110) of a building, said inflatable sleeve (19) secured to the mounting fixture for breaking up ice and snow built up on a bottom portion of the roof.

9. A method of modifying a panel roof (10) to remove ice and snow in a controlled manner comprising the steps of removing a lower panel portion of a roof (56*a*), securing an edge of an inflatable sleeve (19) near the end of the panel roof, and securing an opposite edge of the inflatable sleeve to a building such that ice and snow built up over the inflatable sleeve breaks up and falls in a controlled manner when the sleeve is inflated, said sleeve then returning to its original location.

10. The apparatus of claim 7, said insert (173) extending past a bottom edge of a roof and suitably adapted to direct the flow of ice, snow, and water away from a building.

11. An apparatus for removing ice and snow surrounding a drain cage (194) comprising an inflatable ring (19*r*) secured at an edge adjacent to the drain cage (194), and a clamp ring (195) securing the inflatable ring (19*r*) at an edge opposite the drain cage (194).

12. The apparatus of claim 1 or 7, said bottom end folded and secured to the bottom side to form a compartment, and a material (122*b*) disposed within said compartment to weigh down the end and to provide a wrinkle-free appearance.

13. A method of removing ice and snow from roofs comprising the steps of securing a flexible cover (121), having a top edge and a bottom edge, by its top edge along a lower portion of a roof (10), securing a pull cord assembly (204) near the bottom edge of the flexible cover (121), engaging the pull cord assembly (204) with an extension pole (205), and agitating the cover (121) with the extension pole (205) to break loose ice and snow disposed upon a top surface of the cover.

14. The apparatus of claim 1 or 7 wherein said top end is secured between a section of flashing (207) and a roof deck (10).

15. The apparatus of claim 1, said cover (121) having a top side substantially slippery and impervious to moister between the ice and snow and the roof (10) to more easily remove ice and snow from the roof and to provide a leak proof barrier.

16. A method of securing a device for removing ice and snow from shingled roofs to a roof comprising providing at least one end tab (121*x*) on a flexible cover (121) and securing said end tab (121*x*) under a shingle to prevent edges of said cover from becoming dislocated.

17. A method for securing a device for removing ice and snow from shingled roofs to a roof comprising providing at least one end tab (121*x*) on an inflatable sleeve (19) and securing said end tab (121*x*) under a shingle to prevent edges of said sleeve from becoming dislocated.

18. A method for securing a device for removing ice and snow from a roof to a roof comprising the steps of providing a bungee loop assembly (124) secured to an inflatable sleeve (19), said bungee loop assembly comprising an opening (210) near an edge of said bungee loop assembly (124) and a bungee cord (21) running the length of said bungee loop assembly (124), forming a loop with an end of said bungee cord (21) running through said opening (210), and securing said loop to a fastening means onto a roof to provide lateral tension for the inflatable sleeve (19).

19. The method of claim 18 further comprising the step of providing at least one end flap (121*a*) at an edge of the inflatable sleeve (19) to prevent wind from blowing underneath the sleeve and causing damage to the roof (10).

20. A method for securing a device for removing ice and snow from a roof to a roof comprising the steps of providing a bungee loop assembly (124) secured to a flexible cover (121), said bungee loop assembly comprising an opening (210) near an edge of said bungee loop assembly (124) and a bungee cord (21) running the length of said bungee loop assembly (124), forming a loop with an end of said bungee cord (21) running through said opening (210), and securing said loop to a fastening means onto a roof to provide lateral tension for the flexible cover (121).

21. The method of claim (20) further comprising the step of providing at least one end flap (121*a*) at an edge of the flexible cover (121) to prevent wind from blowing underneath the cover and causing damage to the roof (10).

22. An apparatus for removing ice and snow from roofs comprising an inflatable sleeve (19) having a top edge and a bottom edge, said top edge secured to a roof (10);

a gutter means (13) secured past an end of the roof (10); and a flexible end flap (19*q*) secured at one end near the bottom edge of the inflatable sleeve (19) and secured at an opposite end to the gutter means (13) and substantially conforming to the shape of the gutter means such that as the sleeve (19) is inflated, the end flap (19*q*) lifts up and out of the gutter means and dumps ice and snow and any other material disposed within the gutter means.

23. The apparatus of claim 22 wherein said inflatable sleeve is a flexible cover (121) such that as the cover is manually agitated the end flap lifts up and out of the gutter means and dumps ice and snow and any other material disposed within the gutter means.

24. The apparatus of claim 22 further comprising a cleat (214) secured to a top side of the inflatable sleeve (19) suitably adapted for holding ice formations on the roof until the sleeve (19) is inflated.

25. The apparatus of claim 23 further comprising a cleat (214) secured to a top side of the cover (121) suitably adapted for holding ice formation on the roof until the cover (121) is agitated.

26. An apparatus for removing ice and snow from roofs comprising a flexible cover (121) having a top end and a bottom end, said top end secured to a roof (10), and said bottom end secured below a bottom edge of the roof to provide a slippery surface for facilitating the removal of ice and snow disposed thereon.

27. The apparatus of claim 26 further comprising a heat tape (218) secured to said cover (121) thereby providing an efficient method of applying heat tape to a roof for removing ice and snow.

28. The apparatus of claim 26 wherein said cover (121) is made of an elastic material.

29. The apparatus of claim 7 wherein said sleeve (19) is made of an elastic material.

30. A apparatus for removing ice and snow from roofs comprising a flexible cover (121) having a top edge and a bottom edge, said top edge secured to a roof (10) having an eave (113) with a fastening means (16) and said bottom edge hanging over an end of said roof (10) to protect the eave (113) from damage from ice and snow.

31. A flexible gutter apparatus (223) comprising two substantially linear edges secured in a spaced relationship to each other to maintain the gutter shape and flexible gutter material substantially secured to the linear edges and defining an interior space and suitably adapted to become substantially convex shape when pushed upward from below, thereby emptying any ice, snow and debris that may have accumulated within the gutter.

32. The apparatus of claim 31 further comprising at least one heating tape (211) disposed within the flexible gutter apparatus for melting ice and snow that may accumulate within the interior space of the gutter.

33. The apparatus of claim 26 further comprising at least one water diverter (226) for diverting water away from a doorway (227) secured to said flexible cover.

34. The apparatus of claim 33 wherein said flexible cover is an inflatable sleeve (19).

35. A flexible gutter apparatus (223) comprising two substantially linear edges secured in a spaced relationship to each other to maintain the gutter shape and flexible gutter material substantially secured to the linear edges and defining an interior space and an inflatable compartment (238) disposed within the interior space that is suitably adapted to push out when inflated any ice, snow and debris that may have accumulated within the gutter.

36. The apparatus of claim 35 further comprising a porous material (241) disposed between a gutter (13) and a gutter cover (234).

37. The apparatus of claim 7 further comprising an inflation means pneumatically connected to the sleeve (19) for inflating the sleeve.

38. An apparatus for removing ice and snow from roofs comprising an inflatable sleeve (19) having a top edge and a bottom edge, said top edge secured to a roof (10), and a fence (242) secured near a bottom section of the roof (10), thereby forming a trough (243) when the sleeve (19) is not inflated for preventing snow and ice from sliding off uncontrolled.

39. The apparatus of claim 38 further comprising a tab (244) secured to a bottom side of said sleeve (19) and disposed between the fence (242) and the roof (10).

40. The apparatus of claim 31 wherein said debris is at least one taken from the group consisting of leaves, needles, sticks, and water.

* * * * *